US009613477B2

(12) United States Patent
Bonanni et al.

(10) Patent No.: US 9,613,477 B2
(45) Date of Patent: Apr. 4, 2017

(54) COLLECTION OF INFORMATION USING CONTACTLESS DEVICES IN COMBINATION WITH MOBILE COMPUTING DEVICES

(71) Applicant: International Business Machines Corporation, Armonk, NY (US)

(72) Inventors: Cristina Bonanni, Rome (IT); Patrizia Manganelli, Rome (IT)

(73) Assignee: International Business Machines Corporation, Armonk, NY (US)

( * ) Notice: Subject to any disclaimer, the term of this patent is extended or adjusted under 35 U.S.C. 154(b) by 155 days.

(21) Appl. No.: 14/692,202

(22) Filed: Apr. 21, 2015

(65) Prior Publication Data

US 2016/0314633 A1 Oct. 27, 2016

(51) Int. Cl.

| | |
|---|---|
| ***G05B 19/00*** | (2006.01) |
| ***G07C 9/00*** | (2006.01) |
| ***G07C 9/02*** | (2006.01) |

(52) U.S. Cl.

CPC ..... *G07C 9/00111* (2013.01); *G07C 9/02* (2013.01)

(58) Field of Classification Search

CPC ..... G07C 9/00111; G07C 9/02

See application file for complete search history.

(56) References Cited

U.S. PATENT DOCUMENTS

| | | | |
|---|---|---|---|
| 6,433,691 | B1 | 8/2002 | Hilliard et al. |
| 8,483,685 | B2 | 7/2013 | Ghai et al. |
| 8,612,181 | B2 | 12/2013 | Czaja et al. |
| 8,669,845 | B1 | 3/2014 | Chakraborty et al. |
| 8,674,805 | B2 | 3/2014 | Charych |
| 2002/0070863 | A1 | 6/2002 | Brooking |
| 2010/0105409 | A1 | 4/2010 | Agarwal et al. |

(Continued)

FOREIGN PATENT DOCUMENTS

DE 10 2009 005 209 A1 7/2010

OTHER PUBLICATIONS

Dai et al., "Mobile phone-based pervasive fall detection", Springer, Received: Jan. 21, 2010, Accepted: Mar. 2, 2010, Published online: Apr. 8, 2010, <http://www.cis.umassd.edu/~xbai/pubs/J-FallDection.pdf>.

(Continued)

*Primary Examiner* — Omeed Alizada
(74) *Attorney, Agent, or Firm* — Maeve Carpenter

(57) ABSTRACT

An approach for collecting information in a facility including a plurality of users, wherein each of the plurality of users includes at least one contact-less device for accessing the facility, wherein the contact-less device stores an identifier, and at least one of the plurality of users includes a wireless computing device, is provided. The approach broadcasts an interrogation signal by a selected wireless computing device from at least one of the plurality of users. The approach receives a response signal to the interrogation signal by the selected wireless computing device from each of one or more proximal contact-less devices of one or more contact-less devices within the operating range of the selected wireless computing device. The approach generates a collection message from the selected wireless computing device. The approach transmits the collection message from the selected wireless computing device to a central computing system.

17 Claims, 10 Drawing Sheets

(56) References Cited

U.S. PATENT DOCUMENTS

2015/0099537 A1* 4/2015 Merithew ..... H04W 4/021
455/456.1

OTHER PUBLICATIONS

Eisenman et al., "Poster Abstract: SkiScape Sensing", SenSys '06, Nov. 1-3, 2006, Copyright 2006 ACM, <http://www.ee.columbia.edu/~shane/projects/sensornet/metrosense/pp06-eisenman.pdf>.
"ISO/IEC 15693", from Wikipedia, the free encyclopedia, last modified on Oct. 23, 2014, <http://en.wikipedia.org/wiki/ISO/IEC_15693>.
Lee et al., "RF-GPS: RFID Assisted Localization in VANETs", IEEE 6th International Conference on Mobile Adhoc and Sensor Systems, 2009 (MASS '09), Oct. 12-15, 2009, <http://202.114.89.42/resource/pdf/4304.pdf>.
"Performance Check—Wellbeing factor: Follow the new wellbeing track", Dolomiti Superski, downloaded on Mar. 23, 2015, <http://www.dolomitisuperski.com/en/ski-pass/performance-check>.
Roberti, "NFC Phones Can Read ISO 15693 Tags", Feb. 1, 2011, RFID Journal Blog, <http://www.rfidjournal.com/blogs/rfid-journal/entry?8182>.

* cited by examiner

COLLECTION OF INFORMATION USING CONTACTLESS DEVICES IN COMBINATION WITH MOBILE COMPUTING DEVICES

BACKGROUND

The present disclosure relates generally to the information technology field, and more particularly to the collection of information in a facility.

Different types of facilities are available to provide a large variety of services to users thereof. A typical example is a ski resort, which comprises one or more slopes for skiing and corresponding ski lifts for transporting users of the ski resort (i.e., skiers) uphill to the top of the slopes. Generally, each ski lift is provided with one or more turnstiles that control access thereto; each skier purchases a ski-pass, which allows him/her to pass through the turnstiles in order to board the corresponding ski lifts.

The turnstiles of modern ski resorts implement a hand-free mechanism. In this case, each ski-pass comprises a radio-frequency identification (RFID) tag that stores an indication of a corresponding validity period. Each turnstile is provided with an RFID station, which reads the RFID tag of the ski-pass of each skier that reaches the turnstile and causes the turnstile to open when the validity period of the ski-pass is not expired. This significantly increments the speed of the passage through the turnstiles (since the skiers do not have to handle the ski-passes that may be kept in their pockets) and reduces an operating cost of the ski resort (since the access to the ski lifts is controlled automatically without the need of dedicated staff).

The ski-passes based on RFID tags may also be used to provide additional services. For example, Chakraborty et al. (U.S. Pat. No. 8,669,845 B1) describes a known monitoring system wherein an RFID scanner located at a boarding location of the ski lifts reads a unique identifier of an access product of each customer of a ski resort, and then determines the skier behavior accordingly. Likewise, the "Performance Check" of the known "Dolomiti Superski" registers ski-pass passages at the entry of the lift facilities; each skier may then see the lifts used, the kilometers travelled and the number of meters in altitude difference covered during the day.

In addition, Brooking (US Pub. No. 2002/0070863 A1) describes a known system for tagging skiers, wherein a first type of tag detectors detects signals (comprising corresponding unique identification codes) from tags carried by the skiers as they pass through entrances to areas, and a second type of tag detectors (with a larger detection range) is provided for detecting signals from the tags in the areas (for safety reasons or to provide a search and rescue capability). Likewise, "Poster Abstract: SkiScape Sensing—SenSys '06, Nov. 1-3, 2006, Boulder, Colo., USA—Shane B. Eisenman, Andrew T. Campbell" describes a known application for gathering semi-regular trail condition data and for tracking skier mobility; the application is based on data continuously supplied by ski lifts, static sensors mounted on light poles and mobile sensors mounted on skiers.

Other techniques have also been proposed for helping the skiers. For example, Czaja et al. (U.S. Pat. No. 8,612,181 B2) describes a known system for remote monitoring skier performance. For this purpose, various MEMS sensors embedded in skier clothing and equipment measure instantaneous changes in acceleration; the instantaneous measurements are analyzed, and a corrective response to MEMS actuators embedded in the ski or ski bindings may be sent for changing the parameters of the run or providing enhanced safety. Moreover, Hilliard et al. (U.S. Pat. No. 6,433,691 B1) describes a known personal collision warning and protection system, wherein a sensor measures a relative range and a relative velocity between a skier and an obstacle in the path. A decision logic and control circuit accordingly determines when there is a hazard, and then activates a warning device; when the circuit determines that the skier cannot avoid the obstacle, an air bag located on the front portion of a jacket worn by the skier is inflated to protect the skier.

SUMMARY

Aspects of an embodiment of the present invention disclose a method, a computer system, and a computer program product for collecting information in a facility including a plurality of users, wherein each of the plurality of users includes at least one contact-less device for accessing the facility, wherein the at least one contact-less device stores an identifier, and at least one of the plurality of users includes a wireless computing device. Responsive to an interrogation request, the method includes broadcasting, by one or more computer processors, an interrogation signal by a selected wireless computing device from at least one of the plurality of users, wherein the interrogation signal includes an operating range. The method includes receiving, by one or more compute processors, a response signal to the interrogation signal by the selected wireless computing device from each of one or more proximal contact-less devices of one or more contact-less devices within the operating range of the selected wireless computing device, wherein the response signal includes an identifier of each of the one or more proximal contact-less devices. The method includes generating, by one or more computer processors, a collection message from the selected wireless computing device based, at least in part, on one or more response signals received from each of the one or more proximal contact-less devices. The method includes transmitting, by one or more computer processors, the collection message from the selected wireless computing device to a central computing system.

DETAILED DESCRIPTION

Implementation of such embodiments may take a variety of forms, and exemplary implementation details are discussed subsequently with reference to the Figures.

Figure 1:
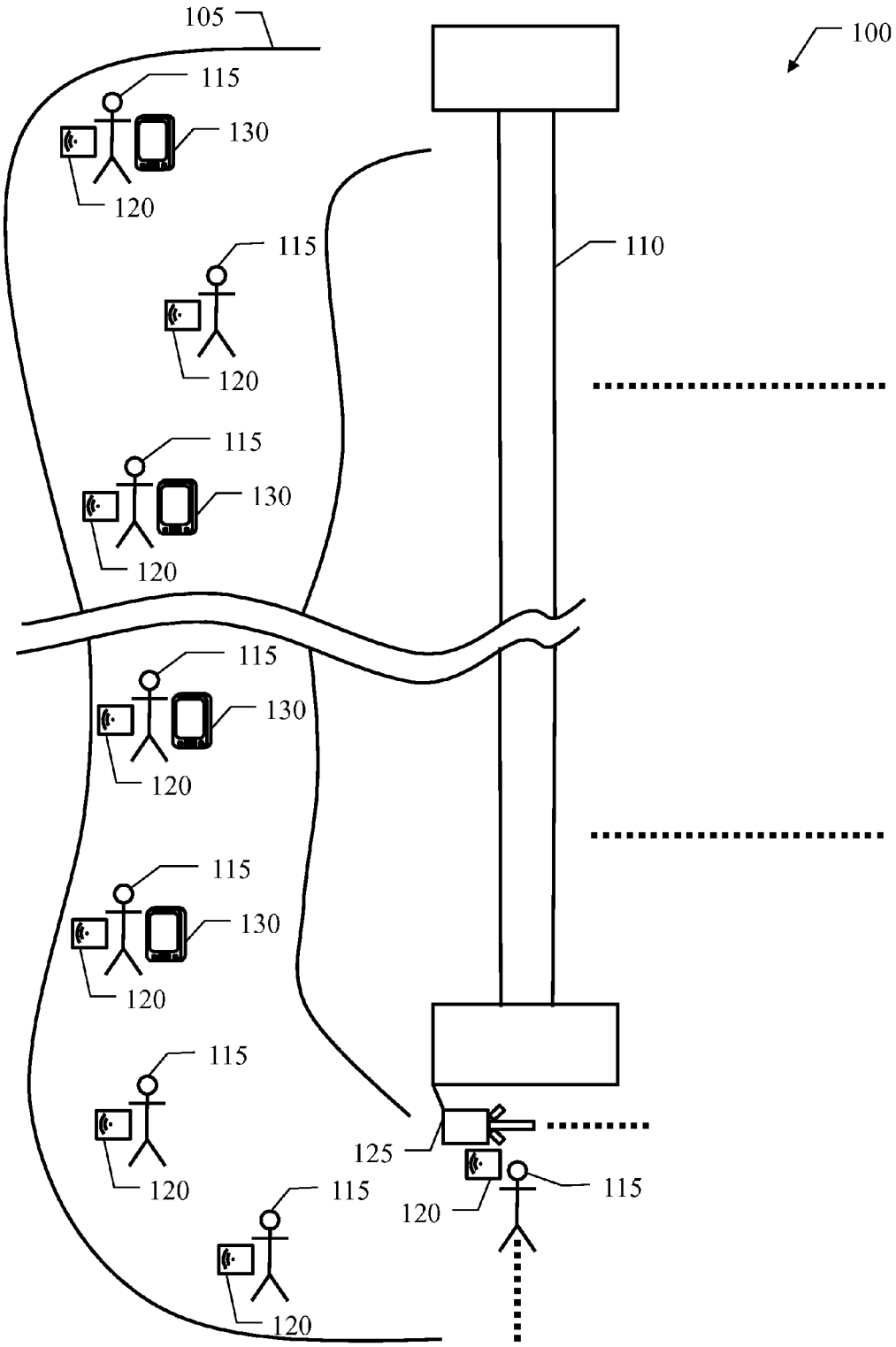
FIG. 1 depicts a pictorial representation of a facility wherein the solution according to an embodiment of the present disclosure may be applied.

The present invention will now be described in detail with reference to the Figures. FIG. 1 depicts a pictorial representation of a facility wherein the solution according to an embodiment of the present disclosure may be applied.

Particularly, the facility is a ski resort 100. The ski resort 100 is a location (typically in a mountain area) that is specifically equipped for practicing winter sports; for example, the ski resort 100 is used to practice downhill winter sports, and specifically ski and snowboard (in the following, reference will be made to ski only for the sake of conciseness).

The ski resort 100 comprises one or more slopes 105 (also known as trails, groomed runs or pistes); the slopes 105 are marked paths downhill that may be used for skiing. The ski resort 100 further comprises one or more lift systems, or ski lifts, 110 (for example, chairlifts, gondola lifts, platter lifts); the ski lifts 110 are used to transport users of the ski resort 100, i.e., skiers 115, uphill to the top of the slopes 105 (so as to allow them to ski along the slopes 105).

The skiers 115 generally pay a subscription price to have access to the ski lifts 110 (and possibly to other services offered by the ski resort 100, such as a ski patrol for rescuing injured skiers 115); typically, the subscription price provides unlimited access to the ski lifts 110 for a corresponding period of time (for example, some hours, one or more days or a whole season). Each skier 115 who has paid the subscription price for the desired period of time receives a ski-pass 120 (storing a unique identifier thereof); the ski-pass 120 is a small object (generally personal and non-transferable), which may be easily carried by the skier 115 so as to allow him/her to access the ski lifts 110 during a corresponding validity period thereof (with the ski-pass 120 that is generally given back at the end of its validity period in return of a deposit added to the subscription price). In order to control access to the ski lifts 110 only to the skiers 115 with (valid) ski-passes 120, physical barriers are added, for example, in the form of turnstiles 125. Generally, the turnstiles 125 implement a hand-free mechanism for allowing the passage through them (and then the access to the corresponding ski lifts 110). In this case, each ski-pass 120 is a contact-less device (for example, based on an RFID tag), which stores an indication of its validity period (for example, a corresponding expiration time); each skier 115 carries the corresponding ski-pass 120 in a safe place (for example, in a dedicated pocket provided on a sleeve of his/her ski jacket). The turnstile 125 is provided with an RFID station (not shown in the figure), which continuously broadcasts an interrogation signal with a very short operating range, so as to ensure that it does not reach the ski-passes 120 of the skiers 115 around it. Each skier 115 that reaches the turnstile 125 puts his/her ski-pass 120 close to its RFID station (for example, by simply raising the arm with the corresponding pocket). In this way, the interrogation signal energizes the RFID tag of the ski-pass 120, which then returns an indication of its validity period to the turnstile 125. Assuming that the validity period of the ski-pass 120 has not expired, the turnstile 125 automatically opens to allow the passage of the skier 115.

Each one of at least part of the skiers 115 (such as most of the adults but not the kids) further carries a wireless computing device, for example, a (personal) smartphone 130. The smart-phone 130 is a mobile device, which is designed to be transported during its normal operation (and then it is quite small and light, and supplied by battery). The smart-phone 130 provides the features of a mobile phone, so that it may be used by the skier 115 to perform telephone calls and to exchange text/multimedia messages (by means of a radio connection over a cellular network). Moreover, the smart-phone provides the features of a computer, so that it may be used to run a number of mobile software applications (also known as apps).

In the solution according to an embodiment of the present disclosure, the smart-phones 130 exploit the ski-passes 120 to collect information in the ski resort 100. For this purpose, an interrogation signal is broadcast by a (selected) smart-phone 130 in response to an interrogation request (for example, when the skier 115 carrying it falls down, when a corresponding request is received or periodically). The smart-phone 130 receives a response signal from each (proximal) ski-pass 120 that is within an operating range of the interrogation signal from the smart-phone 130; each response signal comprises the identifier of the ski-pass 120. The smart-phone 130 generates a collection message according to the (one or more) response signals that have been received (for example, comprising the identifiers of the ski-passes 120 that are close to the skier 115 carrying the smart-phone 130 or indicating the finding of a skier 115 carrying a ski-pass 120 with a specific identifier). The smart-phone 130 then transmits the collection message to a central computing system (not shown in the figure).

The above-described solution allows collecting information about the skiers 115 in a very effective way. Indeed, the information is now collected from the ski-passes 120 (which are carried by all the skiers 115) anywhere. Therefore, it is possible to trace the actual position of all the skiers 115 throughout the whole ski resort. At the same time, this result is achieved by exploiting the smart-phones 130 of the skiers 115; therefore, no complex infrastructure is required, so that the proposed solution may be implemented at very low cost.

The above-described technique may be exploited for a number of purposes (as described in detail below). In any case, in order to avoid any privacy concern, the identifiers may be simple codes that do not allow identifying the corresponding skiers 115 by the smart-phones 130. If necessary (for example, for investigating accidents or for searching specific skiers 115) the name of each skier 115 may be associated with the identifier of his/her ski-pass 120 (for example, when it is purchased); however, this information may be maintained protected to avoid any unauthorized access thereto.

Figure 2A:
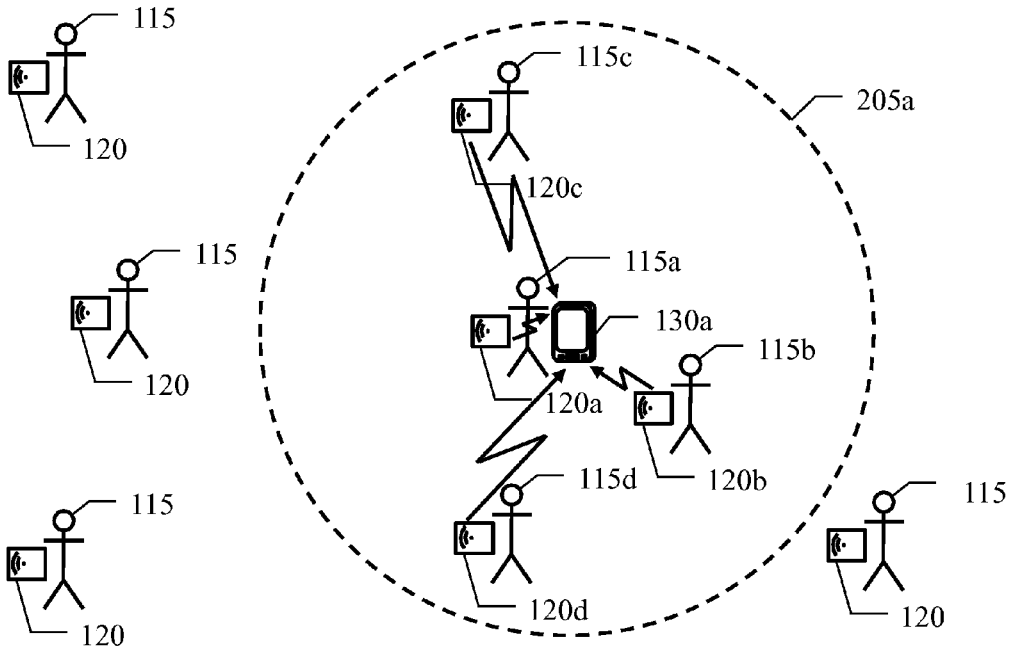
FIG. 2A-FIG. 2B depict a pictorial representation of an exemplary scenario of application of the solution according to an embodiment of the present disclosure.
Figure 2B:
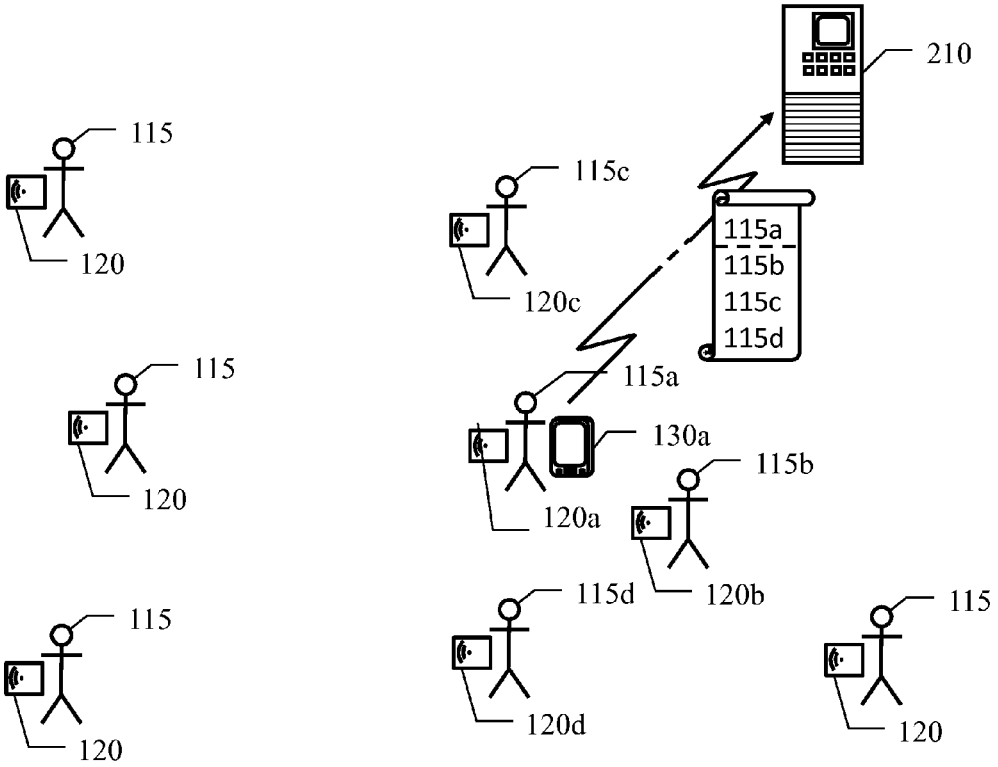

With reference now to FIG. 2A-FIG. 2B, a pictorial representation is shown of an exemplary scenario of application of the solution according to an embodiment of the present disclosure.

Starting from FIG. 2A, a generic skier that carries his/her smart-phone in addition to his/her ski-pass (differentiated with the references 115*a*, 130*a* and 120*a*, respectively) is involved in a possible accident. The smart-phone 130*a* detects the accident almost in real-time (for example, when the skier 115*a* falls down). In response thereto, the smart-phone 130*a* broadcasts the interrogation signal; the interrogation signal is effective within a proximity area 205*a* around the smart-phone 130*a* (at most at a distance therefrom equal to its operating range). The ski-pass of any other skier within the proximity area 205*a* (in addition to the ski-pass 120*a* of the skier 115*a* himself/herself) receives the interrogation signal; in the example at issue, three skiers with the corresponding ski-passes (differentiated with the references 115*b*,115*c*,115*d* and 120*b*,120*c*,120*d*, respectively) are within the proximity area 205*a*. Therefore, the interrogation signal energizes the ski-passes 120*a* 120*b*, 120*c* and 120*d*, which return their identifiers to the smart-phone 130*a* (whereas the ski-passes 120 of other skiers 115 outside the proximity area 205*a* are unaffected by the interrogation signal since its level is too low at their distance from the smart-phone 130*a*).

Moving to FIG. 2B, the smart-phone 130*a* accordingly generates the collection message. Particularly, the collection message comprises the identifier of the ski-pass 120*a* (of the skier 115*a* that has fallen down) and the identifiers of the ski-passes 120*b*, 120*c* and 120*d* (of the skiers 115*b*, 115*c* and 115*d*, respectively, close to the skier 115*a*); in an embodiment of the present disclosure, the collection message also comprises an indication of a distance of the skiers 115*b*, 115*c* and 115*d* from the skier 115*a* (calculated according to a delay of the corresponding response signals from the interrogation signal). The smart-phone 130*a* then transmits this collection message to the central system (denoted with the reference 210), for example, over the Internet using its 3G/4G functionality.

The information so collected may be very useful when the accident of the skier 115*a* (recognized by the identifier of his/her ski-pass 120*a*) has been caused by a collision with another skier. Indeed, in this case it is possible to readily identify the other skiers 115*b*, 115*c* and 115*d* (recognized by the identifiers of their ski-passes 120*b*, 120*c* and 120*d*, respectively) that might help in reconstructing the dynamics of the collision. Particularly, the closest skier 115*b* may be the one involved in the collision; the other skiers 115*c* and 115*d* may instead be witnesses of the collision to be heard. This result is achieved with a very low energy consumption. Indeed, the smart-phone 130*a* broadcasts the interrogation signal and transmits the collection message very seldom (i.e., only when an accident occurs); therefore, the interrogation signal may have a relatively large operating range (so as to identify more skiers that may be useful) and the collection message may be transmitted to the central system 210 immediately (so as to receive the information in real-time) without any power consumption concern.

Figure 3A:
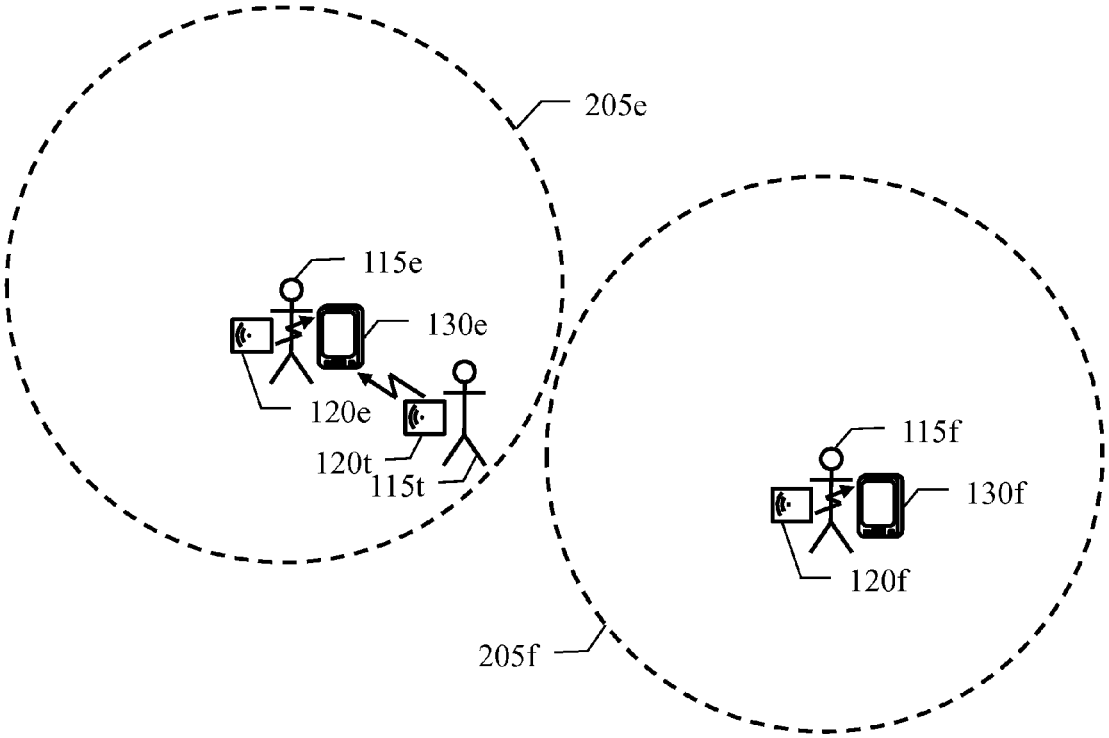
FIG. 3A-FIG. 3B depict a pictorial representation of another exemplary scenario of application of the solution according to an embodiment of the present disclosure.
Figure 3B:
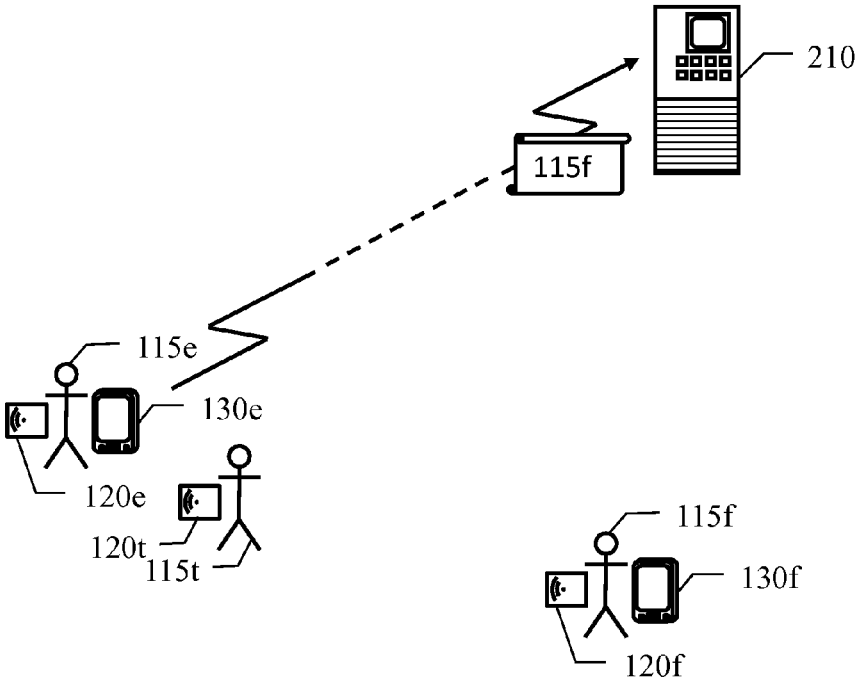

With reference now to FIG. 3A-FIG. 3B, a pictorial representation is shown of another exemplary scenario of application of the solution according to an embodiment of the present disclosure.

Starting from FIG. 3A, a (target) skier that carries his/her ski-pass (differentiated with the references 115*t* and 120*t*, respectively) but has no smart-phone has gotten lost; for example, this may happen to a kid attending a group lesson with a ski instructor. In this situation, any other person (for example, the ski instructor or the parents of the kid) addresses the staff of the ski resort. The staff of the ski resort determines the identifier of the ski-pass 120*t* associated with the skier 115*t* and generates a search message comprising it; the central system 210 then transmits this search message to the smart-phones of all the skiers (for example, over the Internet). In response thereto, as above each smart-phone broadcasts the interrogation signal; in the very simple example at issue, two skiers with the corresponding ski-passes and smart-phones (differentiated with the references 115*e*-115*f*, 120*e*-120*f* and 130*e*-130*f*, respectively) are shown with their proximity areas (differentiated with the references 205*e*-205*f*, respectively). The ski-pass of any skier within the proximity areas 205*e*-205*f* receives the interrogation signal, and then it is energized so as to return its identifier to the smart-phones 130*e*-130*f*, respectively. Each smart phone 130*e*-130*f* searches the identifier of the ski-pass 120*t* among the received response signals; in the example at issue, the identifier of the ski-pass 120*t* is found by the smart phone 130*e*, since the skier 115*t* is within its proximity area 205*e* (whereas the other smart phone 130*f* receives the identifier of his/her ski-pass 120*f* and at most the identifiers of the ski-passes of other skiers, not shown in the figure).

Moving to FIG. 3B, the smart-phone 130*e* generates the collection message accordingly. Particularly, the collection message comprises an indication of the finding of the skier 115*t* (for example, indicated by the identifier of the ski-pass 120*t*). The smart-phone 130*e* then transmits this collection message to the central system 210 (for example, again over the Internet). The staff of the ski resort may then contact the skier 115*e*, for example, by calling his/her telephone number.

This strongly facilitates the finding of any skier 115*t* throughout the whole ski resort (especially when it is very large). In this case as well, the desired result is achieved with a very low energy consumption. Indeed, the smart-phones 130*e*-130*f* broadcast the interrogation signal and possibly transmit the collection message to the central system 210 very seldom (i.e., only when the skier 115*t* is searched and when s/he has been found, respectively); therefore, the interrogation signal may have a relatively large operating range (so as to facilitate the finding of the skier 115*t*) and the collection message may be transmitted to the central system 210 immediately (so as to receive the information in real-time) without any power consumption concern.

Figure 4A:
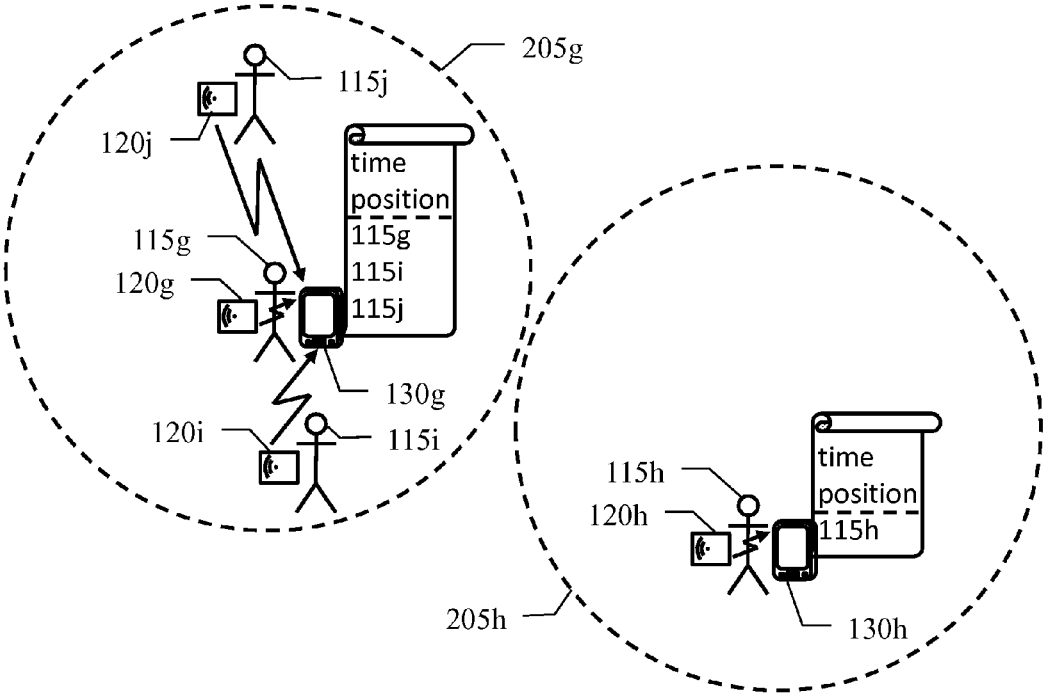
FIG. 4A-FIG. 4B depict a pictorial representation of another exemplary scenario of application of the solution according to an embodiment of the present disclosure.
Figure 4B:
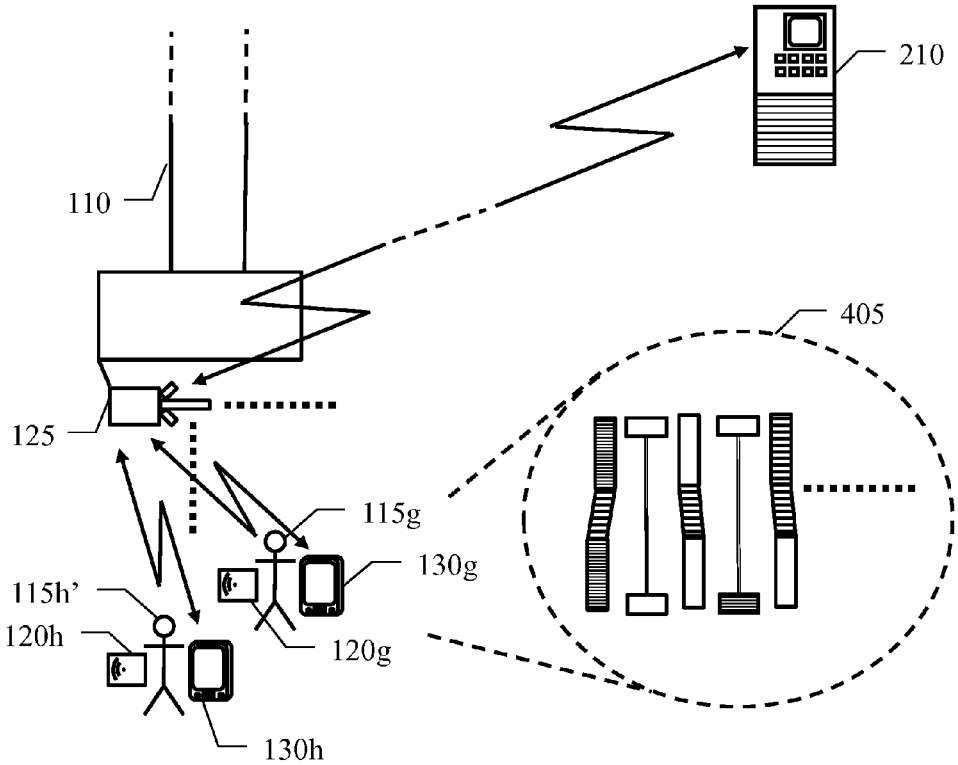

With reference now to FIG. 4A-FIG. 4B, a pictorial representation is shown of another exemplary scenario of application of the solution according to an embodiment of the present disclosure.

Starting from FIG. 4A, the smart-phone of each skier broadcasts the interrogation signal periodically (with a relatively small operating range to limit the power consumption of the smart-phone). In the very simple example at issue, two skiers with the corresponding ski-passes and smart-phones (differentiated with the references 115*g*-115*h*, 120*g*-120*h* and 130*g*-130*h*, respectively) are shown with their proximity areas (differentiated with the references 205*g*-205*h*, respectively). The ski-pass of any skier within the proximity areas 205*g*-205*h* receives the interrogation signal, and then it is energized so as to return its identifier to the smart-phones 130*g*-130*h*, respectively. In this case, the smart-phone 130*g* receives the identifier of the corresponding ski-pass 120*g* and of two other ski-passes 120*i*,120*j*, and the smart-phone 130*h* receives the identifier of the corresponding ski-pass 120*h* only. Each smart-phone 130*g*-130*h* logs tracking information comprising an indication of a current time (for example, measured by a system clock thereof), an indication of a corresponding position (for example, measured by a GPS receiver thereof) and a list of the received identifiers.

Moving to FIG. 4B, the tracking information logged on each smart-phone is uploaded to the central system 210 from time to time. For example, this happens as soon as each skier carrying a smart-phone (such as the same skiers 115*g*-115*h* as above) reaches the start of a generic ski lift 110, and then s/he queues up outside one of its turnstiles 125. In this condition, the corresponding smart-phones 130*g*-130*h* establish a wireless connection with the turnstile 125 (for example, of the Wi-Fi type). The smart-phones 130*g*-130*h* then transmit the collection message (comprising the tracking information that has been logged onto the smart-phones 130*g*-130*h* after a last upload thereof) to the turnstile 125, which in turn transmits it to the central system 210. Moreover, the turnstile 125 may also detect the ski-passes of the skiers, and then their number, which are queued outside it from time to time; as above, the turnstile 125 then transmits tracking information comprising this number to the central system 210.

The tracking information collected by the central system 210 (from either the smart-phones or the turnstiles) may be used for calculating corresponding status information of the ski resort. For example, the central system 210 may calculate the number of skiers that are present along each section of the slopes, and then an indication of their crowding; moreover, the central system 210 may calculate the number of skiers that are queued up outside the turnstiles of each ski lift, and then an indication of a corresponding waiting time for boarding it. The status information may be downloaded to each smart-phone of the skiers (comprising the smart-phones 130*g*-130*h* in the example at issue). Particularly, this may happen at the same time when the smart-phones 130*g*-130*h* connect to the turnstile 125 for uploading their tracking information (with the central system 210 that transmits the status information to the turnstile 125, which in turn transmits it to the smart-phones 130*g*-130*h*). Each smart-phone 130*g*-130*h* may then display a representation 405 of the status information on a screen thereof (for example, in graphical form).

The display of the status information provides a complete (quasi real-time) picture of the crowding condition of all the slopes of the ski resort and of the waiting times of its ski lifts. This assists the skiers in choosing the best slopes and ski lifts, with the consequence that the skiers tend to distribute throughout the entire ski resort more uniformly. Moreover, in the specific embodiment the tracking information is uploaded and the status information is downloaded at the turnstiles. This limits the power consumption of the smart-phones (without requiring any Internet connection); at the same time, this makes the status information available on the smart-phones when it is necessary (for example, for its browsing while the skiers are on the ski lifts).

Figure 5:
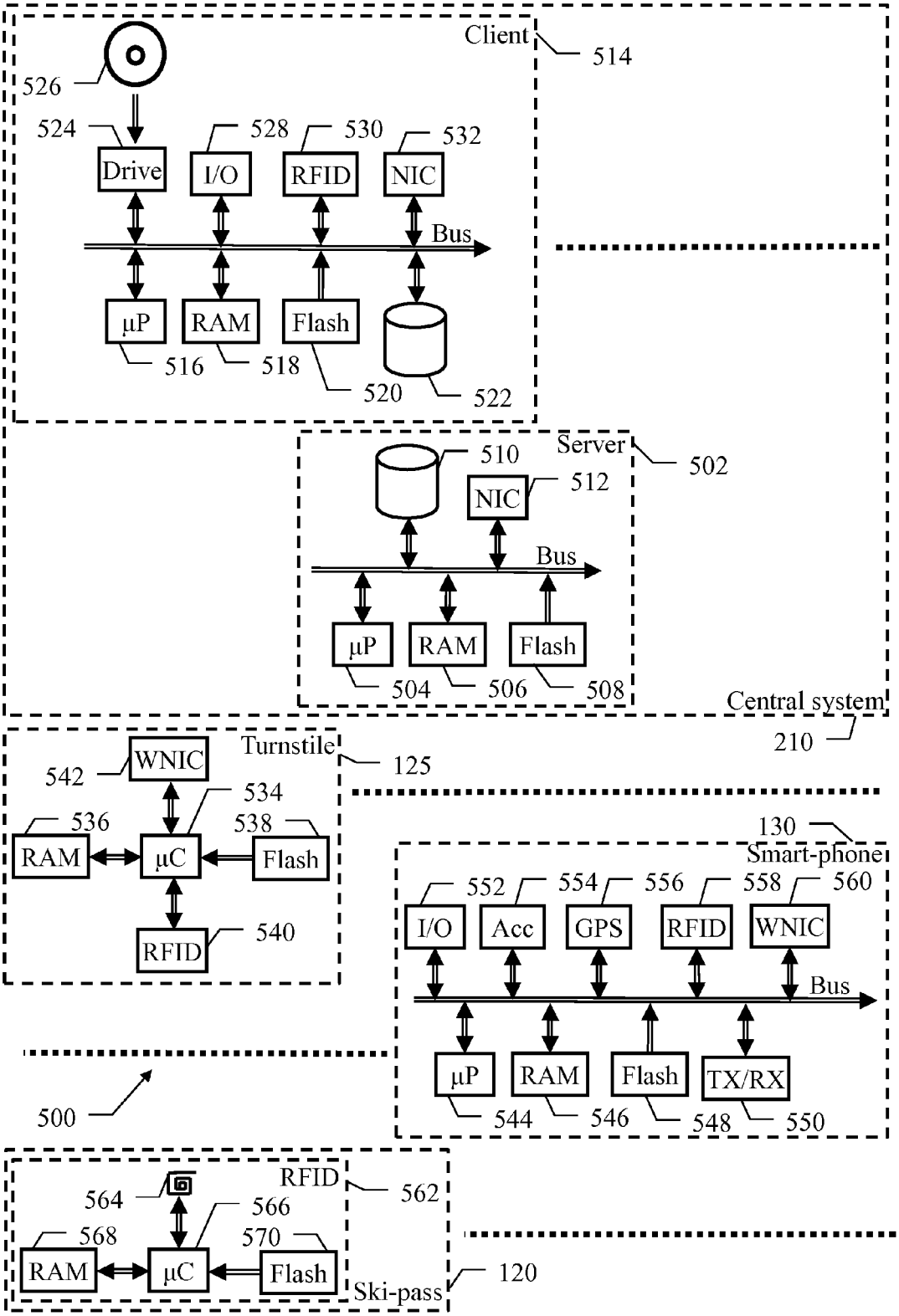
FIG. 5 depicts a schematic block-diagram of a computing infrastructure that may be used to implement the solution according to an embodiment of the present disclosure.

With reference now to FIG. 5, a schematic block-diagram is shown of a computing infrastructure 500 that may be used to implement the solution according to an embodiment of the present disclosure.

The computing infrastructure 500 comprises the central system 210. The central system 210 comprises a server computing machine (or simply server) 502. The server 502 has several units that are connected in parallel to a bus structure. In detail, one or more microprocessors (μP) 504 control operation of the server 502; a volatile memory (for example, a RAM) 506 is directly used as a working memory by the microprocessors 504, and a non-volatile memory (for example, a flash $E^2$PROM) 508 stores basic code for a bootstrap of the server 502. The server 502 also has a mass-memory (storing programs and data) comprising one or more hard disks 510 and a network adapter (NIC) 512 for plugging the server 502 into a LAN of the ski resort (not shown in the figure) and for accessing the Internet.

The central system 210 further comprises one or more client computing machines (or simply clients) 514, only one shown in the figure, which clients 514 may operate as terminals of the central system 210 and/or as a console of the server 502. Each client 514 has several units that are connected in parallel to a bus structure. In detail, a microprocessor (μP) 516 (or more) controls operation of the client 514; a volatile memory (RAM) 518 is directly used as a working memory by the microprocessor 516, and a non-volatile memory (flash $E^2$PROM) 520 stores basic code for a bootstrap of the client 514. The client 514 also has a mass-memory (storing programs and data) comprising a hard disk 522 (or more) and a drive 524 for reading/writing removable storage units 526 (for example, optical disks). The client 514 comprises a number of input/output (I/O) units. Particularly, these I/O units comprise standard units such as a monitor, a keyboard and a mouse (denoted as a whole with the reference 528); as far as relevant to the present disclosure, the I/O units comprise an RFID station 530 for reading/writing the RFID tags and a network adapter (NIC) 532 for plugging the client 514 into the LAN of the ski resort and for accessing the Internet.

The computing infrastructure 500 comprises the turnstiles 125 of all the ski lifts of the ski resort (only one shown in the figure). Each turnstile 125 comprises a micro-controller 534, which has a volatile memory (RAM) 536 (used as a working memory by the micro-controller 534) and a non-volatile memory (flash $E^2$PROM) 538 (used as a mass memory storing a control program of the micro-controller 534). The micro-controller 534 is coupled with an RFID station 540 for reading the RFID tags, and with a wireless network adapter (WNIC) 542, for example, of the Wi-Fi type, for plugging the turnstile 125 into the LAN of the ski resort and for implementing a (Wi-Fi) access point.

The computing infrastructure 500 comprises the smart-phones 130 of the skiers that have accepted to participate in the above-described process of information collection (only one shown in the figure). Each smart-phone 130 comprises several units that are connected in parallel to a bus structure. In detail, a microprocessor (μP) 544 (or more) controls operation of the smart-phone 130; a volatile memory (RAM) 546 is used as a working memory by the microprocessor 544, and an non-volatile memory (flash $E^2$PROM) 548 implements a mass-memory of the smart-phone 130 (storing basic code for a bootstrap of the smart-phone 130, apps and data). The smart-phone 130 comprises a mobile telephone transceiver (TX/RX) 550 for communicating with the cellular network (not shown in the figure). The smart-phone 130 comprises a number of input/output (I/O) units. Particularly, these I/O units comprise standard units such as a touch-screen, command buttons, a loudspeaker, a microphone, a camera, a Bluetooth adapter (denoted as a whole with the reference 552); as far as relevant to the present disclosure, the I/O units comprise an accelerometer 554 for measuring proper acceleration of the smart-phone 130 (for example, along three orthogonal axes), a GPS receiver 556 for measuring a position of the smart-phone 130 (by exploiting a satellite navigation system), an RFID station 558 for reading the RFID tags, and a wireless network adapter (WNIC) 560, for example, of the Wi-Fi type, for communicating with (Wi-Fi) access points.

The computing infrastructure 500 comprises the ski-passes 120 of all the skiers (only one shown in the figure). Each ski-pass 120 comprises a plastic card that embeds an RFID tag 562 of the passive type (i.e., without any own power supply source). The RFID tag 562 comprises an antenna 564 and a micro-controller 566 coupled therewith; the micro-controller 566 has a volatile memory (RAM) 568 used as a working memory by the micro-controller 566, and a non-volatile memory (flash $E^2$PROM) 570 used as a mass memory (storing a control program of the micro-controller 566 and a (worldwide) unique identifier of the RFID tag 562).

Figure 6:
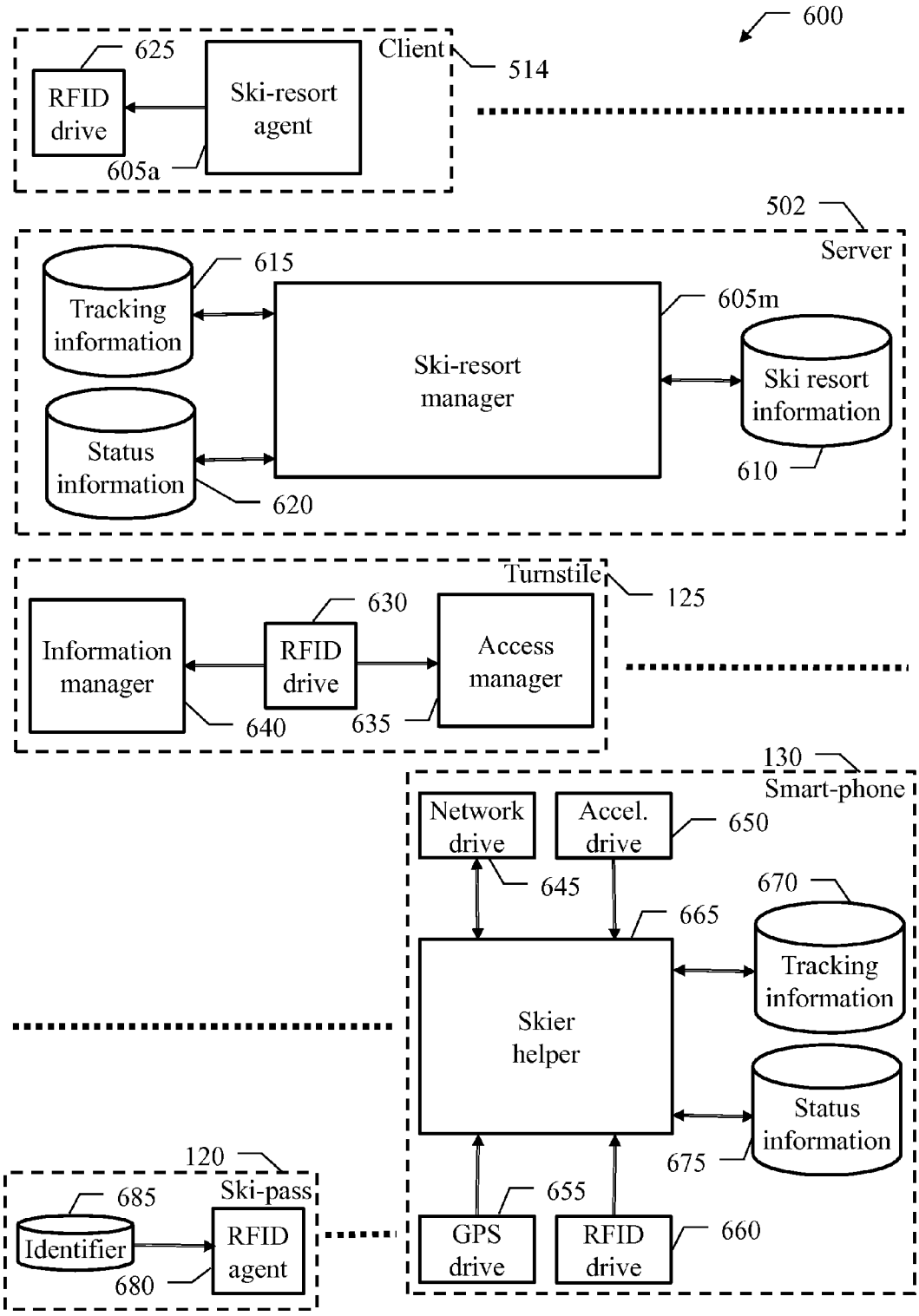
FIG. 6 depicts the main software components that may be used to implement the solution according to an embodiment of the present disclosure.

With reference now to FIG. 6, the main software components are shown that may be used to implement the solution according to an embodiment of the present disclosure.

All the software components (programs and data) are denoted as a whole with the reference 600. The software components 600 are typically stored in the mass memory and loaded (at least partially) into the working memory of the corresponding computing machines (of the above-described computing infrastructure) when the programs are running. The programs are initially installed into the mass memory, for example, from removable storage units or from the Internet. In this respect, each software component may represent a module, segment or portion of code, which comprises one or more executable instructions for implementing the specified logical function.

Particularly, the central system runs a ski resort application for controlling operation of the entire ski resort. The ski resort application has a client/server architecture, with a server component running on the server 502 that implements a ski resort manager 605*m* and a client component running on each client 514 (only one shown in the figure) that implements a ski resort agent 605*a*. The ski resort manager 605*m* controls a ski resort information repository 610 that stores general ski resort information, comprising the identifier of each ski-pass and (possibly) the name of the corresponding skier; the ski resort manager 605*m* further controls a (global) tracking information repository 615 that stores the tracking information that has been collected by all the smart-phones 130 and the turnstiles 125, and a (global) status information repository 620 that stores the status information that has been determined accordingly. Each ski resort agent 605*a* instead runs an RFID drive 625 for driving the corresponding RFID station.

Moving to each turnstile 125 (only one shown in the figure), it runs an RFID drive 630 for driving the corresponding RFID station. The RFID drive 630 is exploited by an access manager 635 for controlling the opening of the turnstile 125. The RFID drive 630 is also exploited by an information manager 640 for uploading the tracking information (from the turnstile 125 itself or from the smart-phones 130 queued up outside it) to the server 502 and for downloading the status information from the server 502 to the same smart-phones 130.

Each smart-phone 130 (only one shown in the figure) runs several (native) apps providing basic functions thereof. As far as relevant to the present disclosure, these apps comprise a network drive 645 for exchanging data over a 3G/4G connection or a Wi-Fi connection (via the telephone transceiver or the Wi-Fi adapter, respectively), an accelerometer drive 650 for driving the accelerometer, a GPS drive 655 for driving the GPS receiver, and an RFID drive 660 for driving the RFID station. The smart-phone 130 also runs a (custom) app that implements a skier helper 665 for performing the process of information collection. For this purpose, the skier helper 665 interfaces with the network drive 645, the accelerometer drive 650, the GPS drive 655 and the RFID drive 660; the skier helper 665 also controls a (local) tracking information repository 670 that stores the tracking information that has been logged by the smart-phone 130, and a (local) status information repository 675 that stores a last version of the status information that has been downloaded from the server 502.

Each ski-pass 120 (only one shown in the figure) runs an RFID agent 680 for managing the corresponding RFID tag; the RFID agent 680 accesses a variable 685 storing the identifier of the RFID tag.

Figure 7A:
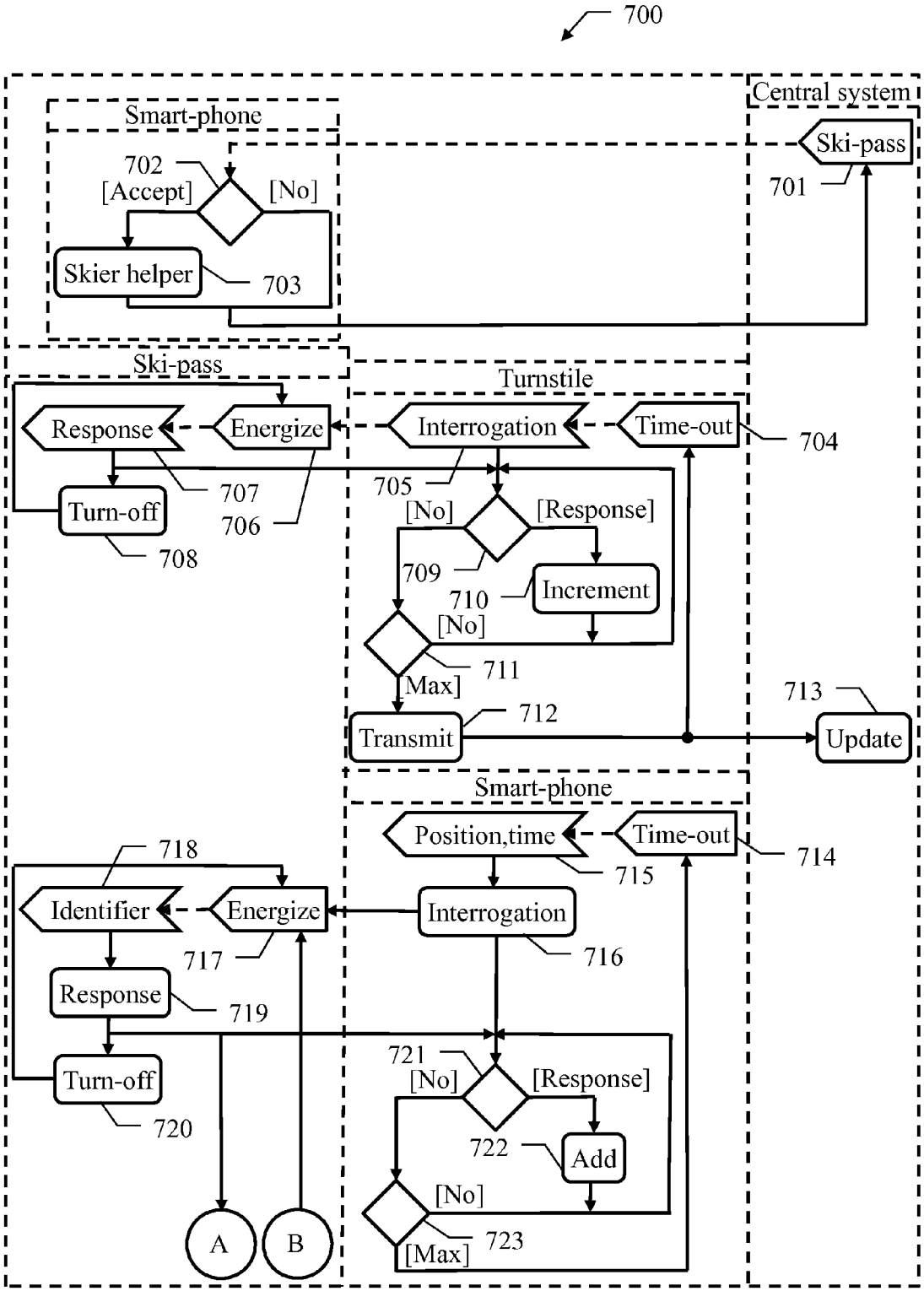
FIG. 7A-FIG. 7C depict a flow diagram describing the operational steps relating to an implementation of the solution according to an embodiment of the present disclosure.
Figure 7B:
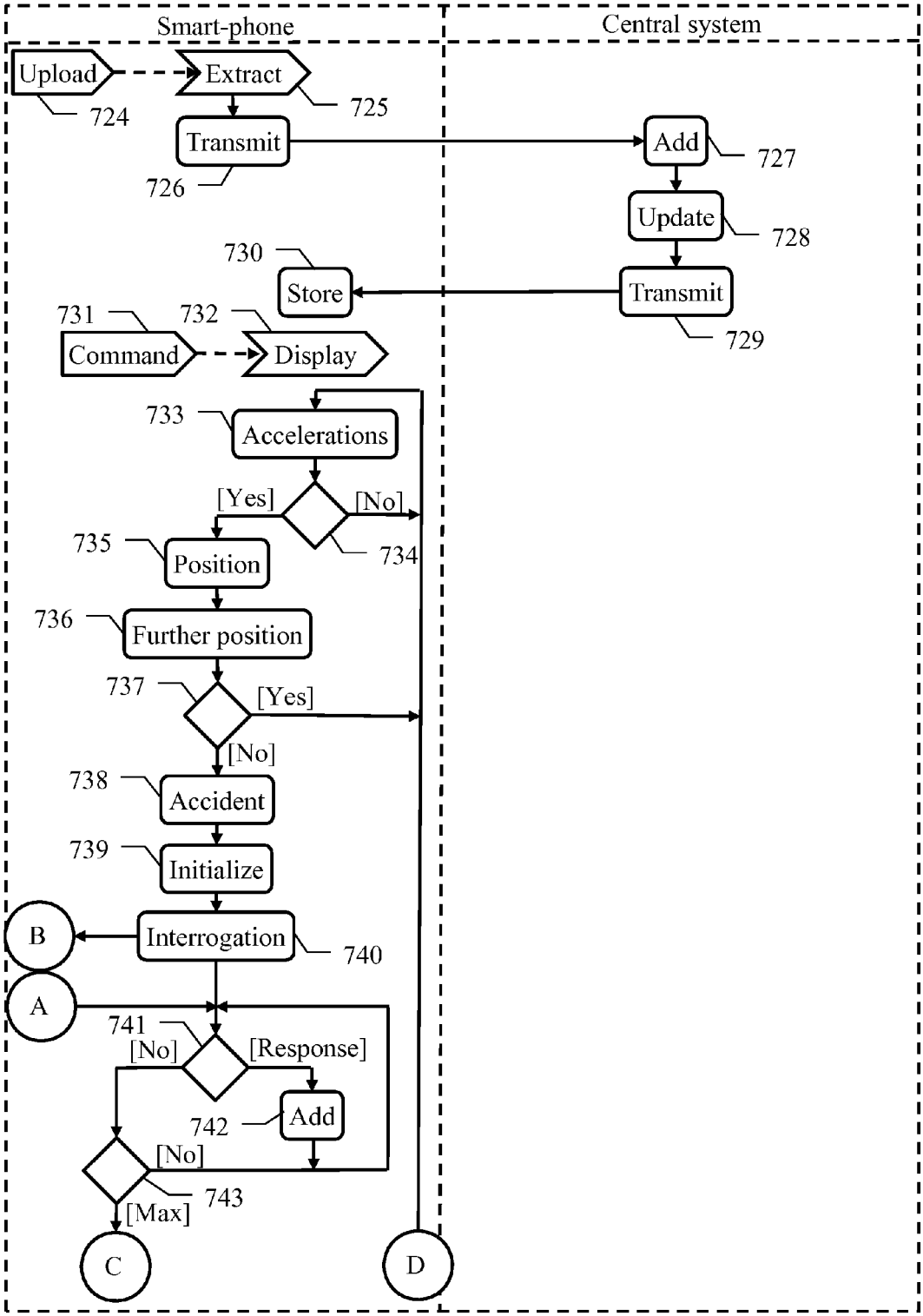
Figure 7C:
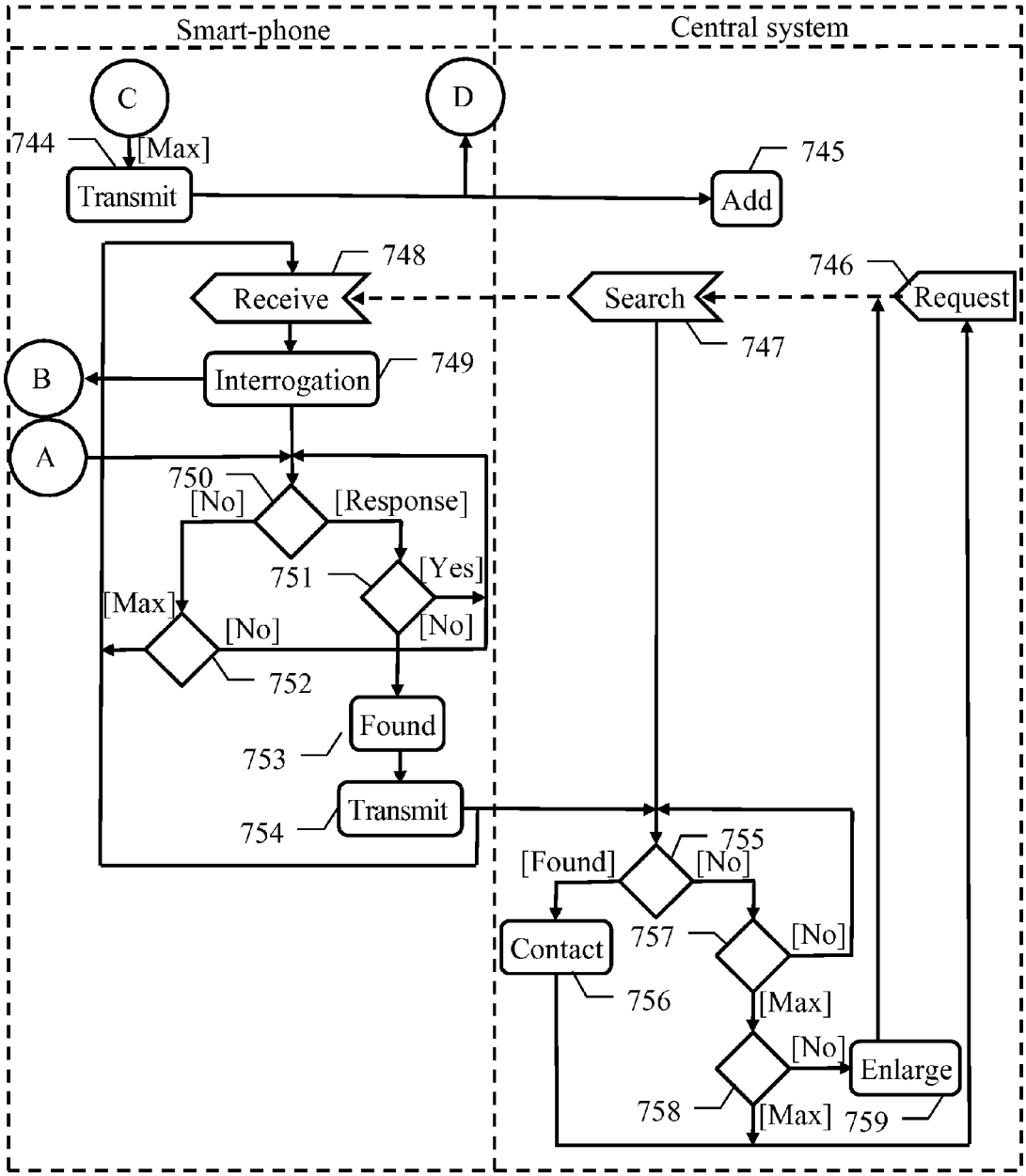

With reference now to FIG. 7A-FIG. 7C, an activity diagram is shown describing the flow of activities relating to an implementation of the solution according to an embodiment of the present disclosure.

Particularly, the diagram represents an exemplary process of information collection with a method 700. In this respect, each block may represent one or more executable instructions for implementing the specified logical function on the above-described computing infrastructure.

Starting from the swim-lane of the central system of the ski resort, a generic skier purchases a ski-pass at block 701. For this purpose, the skier addresses a ticket office of the ski resort, wherein its staff has access to one of more of the clients of the central system. The staff inserts a (new) ski-pass into the RFID station of the client, and then enters the validity period required by the skier and his/her name via the keyboard of the client. The RFID station accordingly writes the validity period of the ski-pass into its RFID tag; at the same time, the ski-resort agent transmits the identifier of the RFID tag of the ski-pass (read therefrom by the RFID station) and the name of the skier to the server of the central system (over the LAN of the ski resort) for the addition of a corresponding new record to the ski resort information repository. The staff then extracts the ski-pass from the RFID station and delivers it to the skier, informing him/her of the possibility of participating in the process of information collection (for example, in return of a discount at the end of the use of the ski-pass).

The flow of activity branches according to the decision of the skier at block 702 in the swim-lane of his/her smart-phone. If the skier decides to participate in the process of information collection (accept branch, block 702), the flow of activity descends into block 703. In this phase, if it is necessary the skier downloads the skier helper, for example, skier helper 665 of FIG. 6, to the smart-phone (for example, by exploiting a free Wi-Fi connection provided by the ski resort around the ticket office) and initializes it (for example, by authorizing the skier helper to read his/her telephone number); in any case, the skier then launches the skier helper (at the same time enabling the GPS receiver, the Wi-Fi adapter and the 3G/4G connection). The flow of activity returns to the block 701 waiting for the purchase of a next ski-pass; the same point is also reached directly from the block 702 if the skier decides not to participate in the process of information collection (no branch, block 702).

Moving to the swim-lane of a main one of the turnstiles of each ski lift (only one shown in the figure), the flow of activity passes from block 704 to block 705 as soon as a pre-determined time-out expires (for example, 10-30 s). In response thereto, the information manager initializes a counter storing a waiting number of the (waiting) skiers that are queued up outside it to zero, and it actuates the corresponding RFID station to broadcast a (turnstile) interrogation signal (for example, a radio wave with a frequency of some GHz) with a (turnstile) operating range enough to cover a whole queuing area outside it (for example, 20-30 m). The RFID station then enters a listening condition for any response signal, while the information manager enters a waiting condition for its receipt (as described below).

Moving to the swim-lane of a generic ski-pass, if it is within the operating range of the (turnstile) interrogation signal the corresponding RFID tag is energized at block 706; particularly, the antenna of the RFID tag transforms the interrogation signal into electric energy by electromagnetic induction, which electric energy supplies its micro-controller. The micro-controller at block 707 drives the antenna of the RFID tag to broadcast a corresponding (turnstile) response signal (for example, a radio wave with a frequency from 100 Hz to 10 GHz and an operating range as the one of the interrogation signal); for example, this response signal may comprise a dedicated code that distinguishes it from the response signals (not shown in the figure) that are used to control the passing through the turnstiles. The micro-controller then turns off at block 708, with the process that returns to the block 706 waiting for a next (turnstile) interrogation signal.

Referring back to the swim-lane of the turnstile, a test is performed at block 709 wherein the information manager verifies whether the RFID station has received any response signal. If so (as notified automatically by the RFID station to the micro-controller)(response branch, block 709), the process descends into block 710; in response thereto, the information manager increments the waiting number by one. The process then returns to the block 709 to repeat the same operations. Referring again to the block 709, if the RFID station has received no response signal (no branch, block 709), a further test is made at block 711 wherein the information manager verifies whether a pre-defined maximum time has lapsed (for example, 5-10 s). If not, (no branch, block 711) the method returns to the block 709 in a waiting loop. Referring again to the block 711, as soon as the maximum time has lapsed (max branch, block 711) the information manager at block 712 transmits a waiting message comprising a (unique) identifier of the ski lift of the turnstile and the waiting number to the server of the central system (over the LAN of the ski resort); the flow of activity then returns to the block 704 waiting for a next expiration of the corresponding time-out.

Moving to the swim-lane of the central system, the ski resort manager receives the waiting message from the turnstile at block 713; in response thereto, the ski resort manager updates the (global) status information repository accordingly. Particularly, the status information repository comprises a record for each ski lift, which stores the waiting number (of the waiting skiers that are currently queued up outside its turnstiles) and an estimated waiting time for boarding it. Therefore, the ski resort manager replaces the waiting number in the status information with the waiting number in the waiting message (after logging its previous value); the ski resort manager then updates the waiting time accordingly, for example, by dividing the waiting number by a known capacity of the ski lift expressed in terms of skiers that may be transported per unit of time (again after logging its previous value).

In a completely independent way, the process passes from block 714 to block 715 in the swim-lane of each smart-phone (only one shown in the figure) as soon as a predetermined time-out expires (for example, 5-10 s). In response thereto, the skier helper measures a current time (provided by the system clock) and a current position of the smart-phone (provided by the GPS receiver). The ski helper then adds a new record to the (local) tracking information repository; the new record comprises an acquisition time (set to the current time), an acquisition position (set to the current position), and a list (initially empty) of the identifiers of the ski-passes that are close to the skier carrying the smart-phone (comprising the one thereof). The skier helper at block 716 actuates the RFID station to broadcast a (smart-phone) interrogation signal as above (for example, with an operating range of 1-5 m). The RFID station then enters a listening condition for any response signal, while the skier helper enters a waiting condition for its receipt (as described below).

Moving to the swim-lane of each ski-pass, if it is within the proximity area of the smart-phone defined by the operating range of its interrogation signal the corresponding RFID tag is energized as above at block 717. The micro-controller at block 718 extracts the identifier of the RFID tag from its non-volatile memory. The micro-controller at block 719 drives the antenna of the RFID tag to broadcast a corresponding (smart-phone) response signal as above, which now comprises the identifier of the ski-pass. The micro-controller then turns off at block 720, with the process that returns to the block 717 waiting for a next (smart-phone) interrogation signal.

Referring back to the swim-lane of the smart-phone, a test is performed at block 721 wherein the skier helper verifies whether the RFID station has received any response signal. If so (as notified automatically by the RFID station to the micro-controller) (response branch, block 721), the process descends into block 722; in response thereto, the skier helper extracts the identifier of the ski-pass from the response signal, and it adds this identifier to the new record of the tracking information repository. The process then returns to the block 721 to repeat the same operations. Referring again to the block 721, if the RFID station has received no response signal (no branch, block 721), a further test is made at block 723 wherein the skier helper verifies whether a pre-defined maximum time has lapsed (for example, 2-5 s). If not (no branch, block 723), the method returns to the block 721 in a waiting loop. Referring again to the block 723, as soon as the maximum time has lapsed (max branch, block 723) the flow of activity returns to the block 714 waiting for a next expiration of the corresponding time-out.

In a completely independent way, the process passes from block 724 to block 725 of FIG. 7B as soon as the tracking information has to be uploaded from the smart-phone to the central system; this happens when the smart-phone connects to the access point provided by any turnstile of the ski resort (i.e., the corresponding skier queues up outside it) or in any case when a pre-defined time-out from a previous upload expires (for example, 15-30 min.). At this point, the skier helper extracts the tracking information that has not been uploaded yet (as indicated by a corresponding pointer) from the tracking information repository. The skier helper at block 726 transmits a collection message comprising this tracking information (referred to as tracking message in this case) to the server of the central system (with the corresponding pointer that is updated accordingly). Particularly, when the smart-phone is connected to the turnstile it transmits the tracking message to the turnstile, not shown in the figure (over its Wi-fi connection), which in turn transmits it to the server (over the LAN of the ski resort); otherwise, the smart-phone directly transmits the tracking message to the server (over the Internet).

Moving to the swim-lane of the central system, the ski resort manager receives the tracking message from the smart-phone at block 727; in response thereto, the ski resort manager adds the tracking information contained therein to the (global) tracking information repository. With reference now to block 728, the ski resort manager updates the (global) status information repository accordingly. For example, the slopes are logically partitioned into a plurality of sections (such as every 10-50 m, each one identified by GPS coordinates of its edges). The status information repository comprises an entry for each slope, which in turn comprises an entry for each section thereof. The entry of each section comprises an array with a predefined number of records (for example, 90-120) for each time slot of a predefined length (for example, 20-60 s from a corresponding start time); each record stores a list of the identifiers of the ski-passes of the skiers that were present in its section during the corresponding time slot and a crowd index (for example, from 0 to 1) measuring an estimated crowd of the section. In this case, the ski resort manager at first verifies whether the current time (as indicated by a system clock of the server) is outside the most recent time slot. If so, a new record is added to the array of each section for a new time slot starting after the end of the most recent time slot (with the record for the oldest time slot that is removed after logging it). In any case, for each (received) record of the tracking information in the collection message the ski resort manager determines the corresponding section (by comparing the acquisition position of the received record with the definition of the sections of the slopes), and then the corresponding record within its array (by comparing the acquisition time of the received record with the definition of the time slots). At this point, for each identifier in the received record the ski resort manager verifies whether it is already present in this record of the status information. If not, the ski resort manager adds the identifier to the record of the status information (to indicate that the corresponding skier was present in the section of the slope during the time slot). At the same time, the ski resort manager updates the corresponding crowd index; for example, the crowd index may be calculated by dividing the number of identifiers (and then skiers) in the record of the status information by a pre-defined maximum number of skiers that may be supported by the section (for example, with the wider the section the higher the maximum number). Continuing to block 729, the ski resort manager transmits a status message containing an updated version of the status information to the smart-phone. As above, when the smart-phone is connected to the turnstile the server transmits the status message to the turnstile, which in turn transmits it to the smart-phone; otherwise, the server directly transmits the status message to the smart-phone. Particularly, the status message comprises the waiting time of each ski lift and the crowd index of each section of the slopes (for example, set to the crowd index of the oldest time slot thereof to ensure that it is significant).

Returning to the swim-lane of the smart-phone, the skier helper receives the status message from the server at block 730; in response thereto, the skier helper updates the (local) status information repository accordingly (by replacing the status information with the content of the status message). In a completely independent way, the process passes from block 731 to block 732 whenever the skier selects a command of the skier helper for viewing the status information of the ski resort. In response thereto, the skier helper retrieves the status information (i.e., the waiting time of each ski lift and the crowd index of each section of the slopes) from the status information repository. The skier helper then displays a graphical representation of the status information on the touch-screen of the smart-phone. For example, this graphical representation comprises a map of the ski resort with all its slopes and ski lifts. The corresponding waiting time is shown at the start of each ski lift; each slope is split into its sections, each one colored according to the corresponding crowd index (for example, according to a palette of green, yellow and red colors with increasing brightness for increasing values of the crowd index).

In a completely independent way, a loop is performed continuously by the skier helper for detecting when the corresponding skier is involved in a possible accident. The loop begins at block 733, wherein the skier helper retrieves the accelerations that are measured by the accelerometer. The skier helper monitors accelerations, measured by the accelerometer associated with a wireless computing device, such as smartphone 130 of FIG. 5, along one or more axis (e.g., x axis, y axis, z axis, north, south, east, west, etc.). The skier helper processes these accelerations to verify whether they are indicative of a fall down of the skier; for example, the fall down is detected when the accelerations along two or more of the three axes of the accelerometer change by more than a predefined threshold (for example, 10-30%) from a previous measure thereof (logged in a corresponding variable). The flow of activity then branches at block 734 according to the result of this verification. Particularly, if the skier helper has not detected any fall down of the skier (no branch, block 734), the process returns to the block 733 to repeat the same operations continuously. Conversely, where the skier helper detects an accelerometer change greater than a pre-defined threshold (i.e., accelerations indicative of a fall down of a skier) (yes branch, block 734), the skier helper at block 735 measures the current position of the smart-phone (provided by the GPS receiver). Continuing to block 736, after a pre-defined delay defining a corresponding monitoring period (for example, 1-5 s), the skier helper further measures the current position of the smart-phone. The skier helper determines whether the two measured positions differ by more than a pre-determined distance threshold at block 737. Where the skier helper determines that the two measured positions differ by more than a pre-determined distance threshold (for example, 2-5 m), meaning that the position of the smart-phone (and then of the skier) has not remained within a corresponding (position) range in the monitoring period (yes branch, block 737), it is likely that no accident at all or no serious accident has occurred; therefore, in this case as well the process returns to the block 733 to repeat the same operations continuously. Conversely, where the skier helper determines that the two measured positions do not differ by more than a pre-determined distance threshold (for example, 2-5 m) (no branch, block 737), the process descends into block 738, wherein the skier helper confirms the detection of an accident condition. Consequently, the skier helper at block 739 creates a collection message (referred to as accident message in this case) comprising an acquisition time (set to the current time), an acquisition position (set to the current position), and a list (initially empty) of the identifiers of the ski-passes of the skiers that may be involved in the accident. The skier helper at block 740 actuates the RFID station to broadcast an (accident) interrogation signal as above (for example, with an operating range of 10-20 m). The RFID station then enters a listening condition for any response signal, while the skier helper enters a waiting condition for its receipt (as described below). Each ski-pass that is within the proximity area of the smart-phone defined by the operating range of this interrogation signal (comprising the one of the skier carrying the smart-phone) returns a corresponding (accident) response signal at the blocks 717-720 as above. A test is performed at block 741 wherein the skier helper verifies whether the RFID station has received any response signal. If so (response branch, block 741) the process descends into block 742. In response thereto, the skier helper extracts the identifier of the ski-pass from the response signal; at the same time, the skier helper measures the current time, and it estimates a distance of the ski-pass from the smart phone according to the time that has lapsed from the acquisition instant (for example, 5-10 cm every 0.1-0.3 ms after 0.5 s). The skier helper adds the identifier of the ski-pass and its distance from the smart-phone to the accident message. The process then returns to the block 741 to repeat the same operations. Referring again to the block 741, if the RFID station has received no response signal (no branch, block 741), a further test is made at block 743 wherein the skier helper verifies whether a pre-defined maximum time has lapsed (for example, 10-20 s). If not (no branch, block 743), the method returns to the block 741 in a waiting loop. Referring again to the block 743, as soon as the maximum time has lapsed (max branch, block 743) the skier helper at block 744 (of FIG. 7C) transmits the accident message to the server of the central system over the Internet; the process then returns to the block 733 to repeat the same operations continuously.

Moving to the swim-lane of the central system, the ski resort manager receives the accident message from the smart-phone at block 745; in response thereto, the ski resort manager updates the ski resort information repository accordingly. Particularly, the ski resort manager extracts the first identifier from the accident message (corresponding to the skier that has fallen down); the ski resort manager than adds the other pieces of information extracted from the accident message (i.e., the acquisition time, the acquisition position and the identifier/distance of the other ski-passes) to the record of the skier that has fallen down (for its possible next use to reconstruct the dynamics of the accident).

In a completely independent way, the process passes from block 746 to block 747 as soon as any person addresses any ticket office of the ski resort for searching a (target) skier (as identified by his/her name) who has gotten lost (and who does not carry any smart-phone for contacting him/her). The staff of the ski resort submits a search request to the server of the central system (through the ski resort agent of the corresponding client). In response thereto, the ski resort manager extracts the (target) identifier of the ski-pass of the target skier from the ski resort repository. The ski resort manager then transmits a search message over the Internet to the smart-phone of each skier participating in the process of information collection and whose ski-pass is still valid (as indicated in the ski resort information repository); the search message comprises the target identifier and a (search) operating range (for example, initially set to 10-20 m). The ski resort manager then enters a waiting condition for any response thereto (as described below).

Moving to the swim-lane of each smart-phone, the skier helper receives the search message from the central system at block 748. In response thereto, the skier helper at block 749 actuates the RFID station to broadcast a (search) interrogation signal as above with the operating range indicated in the search message. The RFID station then enters a listening condition for any response signal, while the skier helper enters a waiting condition for its receipt (as described below). Each ski-pass that is within the proximity area of the smart-phone defined by the operating range of this interrogation signal (comprising the one of the skier carrying the smart-phone) returns a corresponding (search) response signal at the blocks 717-720 as above. A test is performed at bock 750 wherein the skier helper verifies whether the RFID station has received any response signal. If so (response branch, block 750), the process descends into block 751. In response thereto, the skier helper extracts the identifier of the ski-pass from the response signal the skier helper and determines whether the identifier of the ski-pass is different from the target identifier. Where the ski helper determines the identifier extracted from the response signal is different from the target identifier (indicated in the search request) (yes branch, block 751), the process then returns to the block 750 to repeat the same operations. Referring again to the block 750, if the RFID station has received no response signal (no branch, block 750), a further test is made at block 752 wherein the skier helper verifies whether a pre-defined maximum time has lapsed (for example, 15-20 s). If not (no branch, 752), the method returns to the block 750 in a waiting loop. Conversely, as soon as the maximum time has lapsed (max branch, block 752), the method returns to the block 748 waiting for a next search message. Referring again to the block 751, where the ski helper determines the identifier extracted from the response signal is not different from the target identifier (i.e., when the identifier extracted from the response signal is equal to the target identifier) (no branch, block 751), the process descends into block 753 wherein the skier helper generates a collection message (referred to as finding message in this case); the finding message comprises the target identifier (to indicate that the target skier has been found), the telephone number of the smart-phone (read by the skier helper) and its current position (measured by the GPS receiver). The skier helper at block 754 transmits the finding message to the server of the central system over the Internet. In this case as well the method then returns to the block 748 waiting for a next search message.

Returning to the swim-lane of the central system, a test is performed at block 755 wherein the ski resort manager verifies whether it has received any finding message for the target identifier. If so (found branch, block 755), the ski resort manager at block 756 notifies the relevant ski resort agent accordingly so as to allow the corresponding staff to call the telephone number of the smart-phone indicated in the finding message (for example, to instruct the skier carrying the smart-phone to approach the target skier and/or to allow the persons searching the target skier to speak with him/her) and to provide directions towards the position of the target person (as indicated by the position in the finding message); the method then returns to the block 746 waiting for a next search request. Referring back to the block 755, if no finding message for the target identifier has been received a test is made at block 757 wherein the ski resort manager verifies whether a pre-defined maximum time has lapsed (for example, 60-120 s). If not (no branch, block 757), the method returns to the block 755 in a waiting loop. Conversely, as soon as the maximum time has lapsed (max branch, block 757), a further test is made at block 758 wherein the ski resort manager verifies whether a maximum number of attempts to find the target skier has been reached (for example, 2-4). If not (no branch, block 758), the ski resort manager at block 759 enlarges the corresponding operating range (for example, by 5-10 m). The method then returns to the block 746, wherein the ski resort manager transmits a (further) search message comprising this enlarged operating range to the smart-phone of each skier as above; as a result, the same operations are repeated with the enlarged operating range (to increase the possibility of finding the target skier). Referring back to the block 758, as soon as the maximum number of attempts to find the target skier has been reached (max branch, block 758), the process directly returns to the block 746 waiting for a next search request (with further actions that may be taken manually for finding the target skier, for example, by involving the ski patrol).

Naturally, in order to satisfy local and specific requirements, a person skilled in the art may apply many logical and/or physical modifications and alterations to the present disclosure. More specifically, although this disclosure has been described with a certain degree of particularity with reference to one or more embodiments thereof, it should be understood that various omissions, substitutions and changes in the form and details as well as other embodiments are possible. Particularly, different embodiments of the present disclosure may even be practiced without the specific details (such as the numerical values) set forth in the preceding description to provide a more thorough understanding thereof; conversely, well-known features may have been omitted or simplified in order not to obscure the description with unnecessary particulars. Moreover, it is expressly intended that specific elements and/or method steps described in connection with any embodiment of the present disclosure may be incorporated in any other embodiment as a matter of general design choice. In any case, ordinal or other qualifiers are merely used as labels to distinguish elements with the same name but do not by themselves connote any priority, precedence or order. Moreover, the terms include, comprise, have, contain and involve (and any forms thereof) should be intended with an open, non-exhaustive meaning (i.e., not limited to the recited items), the terms based on, dependent on, according to, function of (and any forms thereof) should be intended as a non-exclusive relationship (i.e., with possible further variables involved), the term a/an should be intended as one or more items (unless expressly indicated otherwise), and the term means for (or any means-plus-function formulation) should be intended as any structure adapted or configured for carrying out the relevant function.

For example, an embodiment provides a method for collecting information in a facility having a plurality of users.

However, the method may be applied to any facility (see below, [00120]-[00121].

In an embodiment, each one of the users carries a contact-less device for accessing the facility storing an identifier thereof.

However, the contact-less device may be of any type (for example, based on the NFC technology and even of active type) and for allowing any access to the facility (for example, simply for entering it); moreover, the identifier may be of any type (for example, unique simply at national level).

In an embodiment, each one of at least part of the users carries a wireless computing device.

However, any number of users may carry any type of wireless computing device (for example, a tablet).

In an embodiment, the method comprises broadcasting an interrogation signal by a selected wireless computing device of the wireless computing devices in response to an interrogation request; the interrogation signal has an operating range.

However, the interrogation signal may be of any type (for example, with a different frequency) and it may have any operating range (either the same or different for the various applications); moreover, the interrogation request may be provided in any way, for wireless computing devices selected in any number and in any way (see below, [0086], [00101]-[00103], [00107]-[00108], and [00111]).

In an embodiment, a response signal to the interrogation signal is received by the selected wireless computing device from each proximal contact-less device of the contact-less devices within the operating range from the wireless computing device; the response signal comprises the identifier of the proximal contact-less device.

However, the response signal may be of any type (for example, with different frequency).

In an embodiment, a collection message is generated by the selected wireless computing device according to the one or more response signals received from the proximal contact-less devices.

However, the collection message may be generated in any way, according to any number of response signals that have been received (see below, [0082]-0083], [0099], and [00109]).

In an embodiment, the collection message is transmitted by the selected wireless computing device to a central computing system.

However, the collection message may be transmitted at any time (for example, as soon as it has been generated, periodically or in response to specific events, for example, when a connection is established with any dedicated apparatus of the facility arranged anywhere) and in any way (for example, over the Internet, a Wi-Fi connection, a Bluetooth connection); moreover, the collection message may be transmitted to any central computing system (for example, implemented in a cloud environment).

In an embodiment, the method further comprises detecting an accident condition by the selected wireless computing device; the accident condition is indicative of a possible accident involving the user carrying the selected wireless computing device.

However, the accident condition may be of any type (for example, relating to a violent impact) and it may be detected in any way (see below, [0088], and [0090]-[0098].

In an embodiment, the interrogation request is generated by the selected wireless computing device in response to the detection of the accident condition; in this case the collection message is an accident message indicative of the accident condition and it comprises an indication of the identifier of each proximal contact-less device.

However, the accident message may indicate the accident condition in any way (for example, with a dedicated code) and it may have any content (see below, [00100]).

In an embodiment, said step of detecting the accident condition by the selected wireless computing device comprises monitoring an indication of an acceleration of the selected wireless computing device along at least one axis.

However, the acceleration may be monitored with any number and type of units (for example, one or more gyroscopes); moreover, the accelerations may relate to any number of axes along any directions.

In an embodiment, the accident condition is detected according to said at least one acceleration.

However, the accident condition may be detected in any way (for example, when the difference of the amplitude of a total acceleration and the difference of the amplitude of a vertical acceleration within a triggering time window both exceed a triggering threshold and the difference between the maximum value and the minimum value thereof within a next checking time window are both less than another threshold, as described in "Mobile phone-based pervasive fall detection—Pers Ubiquit Comput DOI 10.1007/s00779-010-0292-x-Jiangpeng Dai, Xiaole Bai, Zhimin Yang, Zhaohui Shen, Dong Xuan").

In an embodiment, said detecting the accident condition by the selected wireless computing device comprises monitoring a position of the selected wireless computing device in a monitoring period following the detection of the accident condition according to said at least one monitored acceleration.

However, the position may be monitored in any way (for example, by exploiting the cellular network with LBS techniques); moreover, the position may be monitored in any monitoring period and in any way (for example, two or more times along it).

In an embodiment, the accident condition is confirmed according to the position of the selected wireless computing device in the monitoring period.

However, the accident condition may be confirmed according to any logics (see below); however, this verification may also be omitted in a simplified implementation.

In an embodiment, said step of confirming the accident condition comprises confirming the accident condition in response to the position of the selected wireless computing device remaining within a position range in the monitoring period.

However, the position range may have any value; in any case, the accident condition may be confirmed in other ways (for example, when an average, minimum or maximum displacement remains below a threshold).

More generally, the accident condition may be detected with additional, alternative or different operations (for example, by monitoring a speed of the wireless computing device).

In an embodiment, said step of generating a collection message by the selected wireless computing device comprises adding (to the accident message) an indication of a current time, an indication of a current position of the selected wireless computing device and/or an indication of a distance of each proximal contact-less device from the selected wireless computing device (which distance is calculated according to a delay of the corresponding response signal from the interrogation signal).

However, the accident message may comprise any number of the above-mentioned pieces of information (down to none), or it may comprise additional, alternative or different pieces of information (for example, the telephone number of the selected wireless computing device).

In an embodiment, the method further comprises receiving the interrogation request by the selected wireless computing device from the central computing system.

However, the interrogation request may be received for any purpose (see below) and in any way (for example, over a Wi-Fi connection).

In an embodiment, the interrogation request comprises an indication of a target identifier of the identifiers to be searched; the collection message is a finding message indicative of a finding of the user carrying the contact-less device storing the target identifier. Said step of generating a collection message by the selected wireless computing device comprises searching the target identifier in the response signal received from each proximal contact-less device, and generating the finding message in response to a positive result of the searching of the target identifier.

However, the finding message may comprise additional, alternative or different pieces of information (for example, down to simply a generic code indicating the finding of any target identifier, when only a search at the time is performed, with or without the telephone number and the current position of the selected wireless computing device). More generally, the interrogation request may be received from the central computing system for different purposes (for example, to upload the corresponding tracking information to the server).

In an embodiment, the method further comprises receiving an enlargement request for enlarging the operating range by the selected wireless computing device from the central computing system; the method then comprises repeating said step of broadcasting the interrogation signal (with the operating range that is enlarged) and said steps of receiving the response signal, searching the target identifier, generating the finding message and transmitting the finding message.

However, the enlargement request may be of any type (for example, a dedicated message different from the interrogation request) and the operating range may be enlarged by any amount (even not uniformly) and in any way (for example, by indicating a delta value to be added); moreover, this operation may be performed any number of times (or it may also be omitted at all). The same technique may also be applied in different contexts (for example, by enlarging the operating range in response to the detection of the accident condition until at least one response message is received).

In an embodiment, the method further comprises generating the interrogation request periodically by the selected wireless computing device.

However, the interrogation request may be generated with any periodicity; alternatively, the same interrogation request may be received from the central computing system (for example, over the Internet).

In an embodiment, the collection message is a tracking message indicative of tracking information corresponding to one or more consecutive interrogation requests.

However, the tracking message may relate to any number of consecutive interrogation requests (down to a single one), and it may be transmitted in any way (for example, over a Wi-Fi connection throughout the facility).

In an embodiment, for each interrogation request the tracking message comprises an indication of the identifier of each proximal contact-less device, an indication of a further current time and/or an indication of a further current position of the selected wireless computing device.

However, the tracking message may comprise additional, alternative or different pieces of information (for example, without the current time when the tracking message is transmitted as soon as the corresponding tracking information has been logged, without the current position when this information may be inferred from other sources such as a Wi-Fi connection).

In an embodiment, the method further comprises receiving a status message by each wireless computing device from the central computing system; the status message comprises an indication of a crowd condition of each one of a plurality of sections of the facility being determined by the central computing system according to the tracking messages received from all the wireless computing devices.

However, the sections of the facility may be in any number and defined in any way (for example, at the level of whole slopes); moreover, the crowd condition of each section may be defined in any way (for example, equal to the single crowd index that is calculated in real-time for each section when the tracking information is transmitted to the central system immediately) and it may be calculated in any way (for example, simply according to the number of users).

In an embodiment, the method comprises displaying a representation of the status message on each wireless computing device.

However, the status message may be represented in any way (either qualitatively or quantitatively); in any case, the same information may be provided in different way (for example, with an acoustic warning when a critical condition is detected).

In an embodiment, the facility comprises one or more access barriers for controlling access thereto; the status message comprises an indication of a waiting time for each access barrier, which is determined by the central computing system according to the contact-less devices being detected by the access barrier in a corresponding queuing area.

However, the access barriers may be in any number and of any type (for example, doors); moreover, the waiting time of each access barrier may be calculated in any way (for example, according to a corresponding service speed that is measured continuously). In any case, this feature is also suitable to be implemented even without the above-mentioned process of information collection.

More generally, the information may be collected for any number of the above-mentioned purposes (down to a single one); for example, it is possible to collect the tracking information only (which tracking information may also be used to reconstruct the dynamics of any accident and to search any target user, possibly by temporarily enlarging the operating range when the accident is detected or the target user is to be searched). Moreover, the information may be collected for additional, alternative or different purposes. For example, it is possible to identify dangerous spots (according to the corresponding number of daily collisions), to identify skiers that do not respect safety distances or speed limits, to identify slopes needing maintenance (according to the corresponding number of collisions or to their crowding).

In an embodiment, the facility is a ski resort and each contact-less device is a ski-pass.

However, the ski resort may be of any type (for example, indoor) and the ski-passes may be of any type (for example, for families or groups). More generally, the same technique may also be applied to other facilities (for example, a theme park, and a museum).

The above-described features may be combined in any way. Generally, similar considerations apply if the same solution is implemented with an equivalent method (by using similar steps with the same functions of more steps or portions thereof, removing some steps being non-essential, or adding further optional steps); moreover, the steps may be performed in a different order, concurrently or in an interleaved way (at least in part).

A further embodiment provides a computer program configured for causing a computing system to perform the above-mentioned method when the computer program is executed on the computing system.

A further embodiment provides a computer program product for collecting information in a facility having a plurality of users (each one of the users carrying a contact-less device for accessing the facility storing an identifier thereof and each one of at least part of the users carrying a wireless computing device). The computer program product comprises a computer readable storage medium having program instructions embodied therewith; the program instructions is executable by each one of the wireless computing devices to cause the wireless computing device to: broadcast an interrogation signal in response to an interrogation request, the interrogation signal having an operating range, receive a response signal to the interrogation signal from each proximal contact-less device (of the contact-less devices) within the operating range from the wireless computing device, the response signal comprising the identifier of the proximal contact-less device, generate a collection message according to the one or more response signals received from the proximal contact-less devices, and transmit the collection message to a central computing system.

A further embodiment provides a system comprising means configured for performing the steps of the above-mentioned method.

A further embodiment provides a wireless computing device for collecting information in a facility having a plurality of users (each one of the users carrying a contact-less device for accessing the facility storing an identifier thereof and each one of at least part of the users carrying the wireless computing device). The wireless computing device comprises a contact-less station for broadcasting an interrogation signal in response to an interrogation request, the interrogation signal having an operating range, and for receiving a response signal to the interrogation signal from each proximal contact-less device (of the contact-less devices) within the operating range from the wireless computing device, the response signal comprising the identifier of the proximal contact-less device. The wireless computing device comprises a processor for generating a collection message according to the one or more response signals received from the proximal contact-less devices. The wireless computing device comprises a transmitter for transmitting the collection message to a central computing system.

Further embodiments provide the above-described computing infrastructure or different components thereof in any combination, for example, the central system alone, a turnstile alone, the central system with the turnstiles, the central system with the ski-passes, the central system with the turnstiles and the ski-passes, the central systems with the ski-passes and the smart-phones.

Generally, similar considerations apply if the system has a different structure or comprises equivalent components or it has other operative characteristics. In any case, every component thereof may be separated into more elements, or two or more components may be combined together into a single element; moreover, each component may be replicated to support the execution of the corresponding operations in parallel. Moreover, unless specified otherwise, any interaction between different components generally does not need to be continuous, and it may be either direct or indirect through one or more intermediaries.

Figure 8:
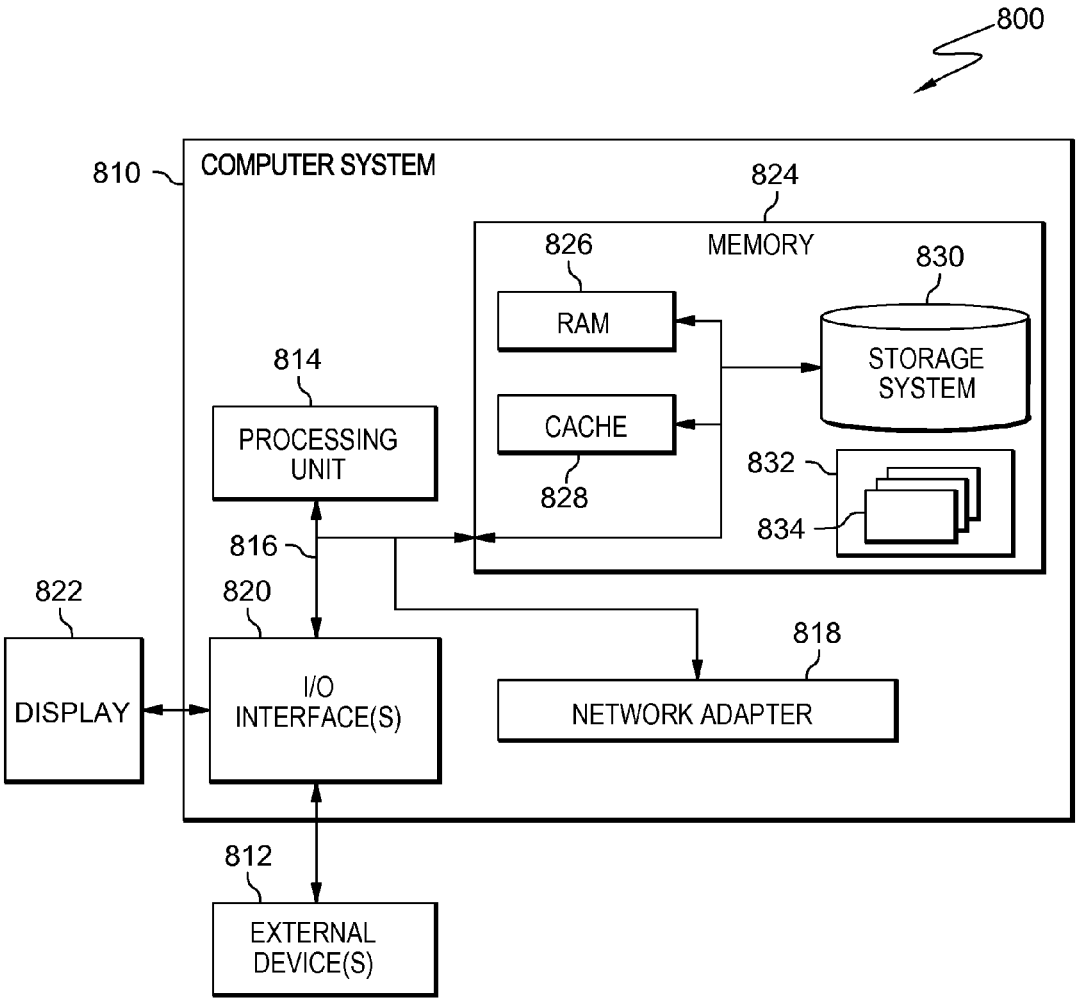
FIG. 8 is a block diagram depicting components of a data processing system (such as the smartphone of FIG. 5), in accordance with an embodiment of the present invention.

FIG. 8 depicts a block diagram of components of data processing system, such as server 502, client 514, and/or smartphone 130 of FIG. 5, generally designated 800, in accordance with an illustrative embodiment of the present invention. It should be appreciated that FIG. 8 provides only an illustration of one implementation and does not imply any limitations with regard to the environments in that different embodiments may be implemented. Many modifications to the depicted environment may be made.

In the illustrative embodiment, smartphone 130 of FIG. 5 is shown in the form of a general-purpose computing device, such as computer system 810. The components of computer system 810 may include, but are not limited to, one or more processors or processing unit 814, memory 824, and bus 816 that couples various system components including memory 824 to processing unit(s) 814.

Bus 816 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system 810 typically includes a variety of computer system readable media. Such media may be any available media that is accessible by computer system 810, and it includes both volatile and non-volatile media, removable and non-removable media.

Memory 824 can include computer system readable media in the form of volatile memory, such as random access memory (RAM) 826 and/or cache memory 828. Computer system 810 may further include other removable/non-removable, volatile/non-volatile computer system storage media. By way of example only, storage system 830 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM, or other optical media can be provided. In such instances, each can be connected to bus 816 by one or more data media interfaces. As will be further depicted and described below, memory 824 may include at least one computer program product having a set (e.g., at least one) of program modules that are configured to carry out the functions of embodiments of the invention.

Program/utility 832, having one or more sets of program modules 834, may be stored in memory 824 by way of example, and not limitation, as well as an operating system, one or more application programs, other program modules, and program data. Each of the operating systems, one or more application programs, other program modules, and program data, or some combination thereof, may include an implementation of a networking environment. Program modules 834 generally carry out the functions and/or methodologies of embodiments of the invention as described herein. Computer system 810 may also communicate with one or more external device(s) 812 such as a keyboard, a pointing device, a display 822, etc., or one or more devices that enable a user to interact with computer system 810 and any devices (e.g., network card, modem, etc.) that enable computer system 810 to communicate with one or more other computing devices. Such communication can occur via Input/Output (I/O) interface(s) 820. Still yet, computer system 810 can communicate with one or more networks such as a local area network (LAN), a general wide area network (WAN), and/or a public network (e.g., the Internet) via network adapter 818. As depicted, network adapter 818 communicates with the other components of computer system 810 via bus 816. It should be understood that although not shown, other hardware and software components, such as microcode, device drivers, redundant processing units, external disk drive arrays, RAID systems, tape drives, and data archival storage systems may be used in conjunction with computer system 810.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

The terminology used herein is for the purpose of describing particular embodiments only and is not intended to be limiting of the invention. It should be appreciated that any particular nomenclature herein is used merely for convenience and thus, the invention should not be limited to use solely in any specific function identified and/or implied by such nomenclature. Furthermore, as used herein, the singular forms of "a", "an", and "the" are intended to include the plural forms as well, unless the context clearly indicates otherwise.

What is claimed is:

1. A method for collecting information in a resort including a plurality of users, wherein each of the plurality of users includes at least one contact-less device for accessing the resort, wherein the at least one contact-less device stores an identifier, and at least one of the plurality of users includes a wireless computing device, the method comprising:

responsive to an interrogation request, broadcasting, by one or more computer processors, an interrogation signal by a selected wireless computing device from at least one of the plurality of users, wherein the interrogation signal includes an operating range;

receiving, by the one or more computer processors, a response signal to the interrogation signal by the selected wireless computing device from each of one or more proximal contact-less devices of one or more contact-less devices within the operating range of the selected wireless computing device, wherein the response signal includes an identifier of each of the one or more proximal contact-less devices;

generating, by the one or more computer processors, a collection message from the selected wireless computing device based, at least in part, on one or more response signals received from each of the one or more proximal contact-less devices;

transmitting, by the one or more computer processors, the collection message from the selected wireless computing device to a central computing system;

detecting, by the one or more computer processors, a collision condition from the selected wireless computing device, wherein the collision condition indicates a possible collision involving a user carrying the selected wireless computing device; and responsive to detecting the collision condition, generating, by the one or more computer processors, the collection message from the selected wireless computing device, wherein the collection message includes a collision message indicative of the collision condition and the identifier of each of the one or more proximal contact-less devices.

2. The method of claim 1, wherein detecting the collision condition from the selected wireless computing device, further comprises:

monitoring, by the one or more computer processors, an indication of an acceleration of the selected wireless computing device along at least one axis; and detecting, by the one or more computer processors, the collision condition based, at least in part, on the at least one acceleration.

3. The method of claim 1, wherein detecting the collision condition from the selected wireless computing device, further comprises:

monitoring, by the one or more computer processors, a position of the selected wireless computing device in a monitoring period following the detection of the collision condition based, at least in part, on the at least one monitored indication of an acceleration; and confirming, by the one or more computer processors, the collision condition based, at least in part, on the position of the selected wireless computing device in the monitoring period.

4. The method of claim 3, wherein confirming the collision condition, further comprises:

responsive to the position of the selected wireless computing device remaining within a position range in the monitoring period, confirming, by the one or more computer processors, the collision condition.

5. The method of claim 1, wherein said generating a collection message by the selected wireless computing device, further comprises:

adding, by the one or more computer processors, at least one of an indication of a current time, an indication of a current position of the selected wireless computing device, an indication of a distance of each of the one or more proximal contact-less devices from the selected wireless computing device to the collision message, wherein the distance of each of the one or more proximal contact-less devices being calculated according to a delay of a corresponding response signal from an interrogation signal.

6. The method of claim 1, further comprising:

receiving, by the one or more computer processors, the interrogation request from the selected wireless computing device at the central computing system.

7. The method of claim 6, wherein the interrogation request includes an indication of a target identifier of a plurality of identifiers to be searched, and wherein the collection message is a finding message indicative of a finding of the user carrying the contact-less device storing the target identifier, and generating, by the one or more computer processors, a collection message by the selected wireless computing device comprises:

searching, by the one or more computer processors, the target identifier in the response signal received from each of the one or more proximal contact-less devices; and responsive to a positive result of the searching of the target identifier, generating, by the one or more computer processors, the finding message.

8. The method of claim 7, further comprising:

receiving, by the one or more computer processors, an enlargement request for enlarging the operating range from the selected wireless computing device from the central computing system; and repeating, by the one or more computer processors, said broadcasting the interrogation signal with an enlarged operating range, said receiving the response signal, said searching the target identifier, said generating the finding message, and said transmitting the finding message.

9. The method of claim 1, further comprising:

generating, by the one or more computer processors, the interrogation request periodically from the selected wireless computing device, wherein the collection message is a tracking message indicative of tracking information corresponding to one or more consecutive interrogation requests, for each interrogation request the tracking message comprising an indication of the identifier of each proximal contact-less device, an indication of a further current time and/or an indication of a further current position of the selected wireless computing device.

10. The method of claim 9, further comprising:

receiving, by the one or more computer processors, a status message by each of one or more wireless computing devices from the central computing system, the status message comprising an indication of a crowd condition of each one of a plurality of sections of the resort, the crowd condition being determined by the central computing system based, at least in part, on one or more tracking messages received from each of the one or more wireless computing devices; and displaying, by the one or more computer processors, a representation of the status message on each of the one or more wireless computing devices.

11. The method of claim 10, wherein the resort comprises one or more access barriers for controlling access thereto, and wherein the status message comprises an indication of a waiting time for each access barrier being determined by the central computing system according to each of one or more contact-less devices being detected by the access barrier in a corresponding queuing area.

12. The method of claim 1, wherein the resort is a ski resort and each of the one or more contact-less devices is a ski-pass.

13. A computer program product for collecting information in a resort including a plurality of users, wherein each of the plurality of users includes at least one contact-less device for accessing the resort, wherein the at least one contact-less device stores an identifier, and at least one of the plurality of users includes a wireless computing device, the computer program product comprising:

one or more computer readable storage media and program instructions stored on the one or more computer readable storage media, wherein the one or more computer readable storage media is hardware, the program instructions comprising:

responsive to an interrogation request, program instructions to broadcast an interrogation signal by a selected wireless computing device from at least one of the plurality of users, wherein the interrogation signal includes an operating range;

program instructions to receive a response signal to the interrogation signal by the selected wireless computing device from each of one or more proximal contact-less devices of one or more contact-less devices within the operating range of the selected wireless computing device, wherein the response signal includes an identifier of each of the one or more proximal contact-less devices;

program instructions to generate a collection message from the selected wireless computing device based, at least in part, on one or more response signals received from each of the one or more proximal contact-less devices;

program instructions to transmit the collection message from the selected wireless computing device to a central computing system;

program instructions to detect an collision condition from the selected wireless computing device, wherein the collision condition indicates a possible collision involving a user carrying the selected wireless computing device; and responsive to detecting the collision condition, program instructions to generate the collection message from the selected wireless computing device, wherein the collection message includes a collision message indicative of the collision condition and the identifier of each of the one or more proximal contact-less devices.

14. The computer program product of claim 13, wherein program instructions to detect the collision condition from the selected wireless computing device, further comprises:

program instructions to monitor an indication of an acceleration of the selected wireless computing device along at least one axis; and program instructions to detect the collision condition based, at least in part, on the at least one acceleration.

15. The computer program product of claim 13, wherein program instructions to detect the collision condition from the selected wireless computing device, further comprises:

program instructions to monitor a position of the selected wireless computing device in a monitoring period following the detection of the collision condition based, at least in part, on the at least one monitored indication of an acceleration; and program instructions to confirm the collision condition based, at least in part, on the position of the selected wireless computing device in the monitoring period.

16. The computer program product of claim 15, wherein program instructions to confirm the collision condition, further comprises:

responsive to the position of the selected wireless computing device remaining within a position range in the monitoring period, program instructions to confirm the collision condition.

17. The computer program product of claim 13, wherein said program instructions to generate a collection message by the selected wireless computing device, further comprises:

program instructions to add at least one of an indication of a current time, an indication of a current position of the selected wireless computing device, an indication of a distance of each of the one or more proximal contact-less devices from the selected wireless computing device to the collection message, wherein the distance of each of the one or more proximal contact-less devices being calculated according to a delay of a corresponding response signal from an interrogation signal.

* * * * *